US008431314B2

(12) United States Patent
Mikuriya et al.

(10) Patent No.: US 8,431,314 B2
(45) Date of Patent: Apr. 30, 2013

(54) COLORED RESIN PARTICLE AND METHOD FOR PRODUCING THE SAME

(75) Inventors: Yoshihiro Mikuriya, Hyogo (JP); Tomoharu Miki, Osaka (JP); Tomohiro Fukao, Osaka (JP); Kazuoki Fuwa, Hyogo (JP); Takuya Kadota, Hyogo (JP); Yoshimichi Ishikawa, Hyogo (JP); Atsushi Yamamoto, Shizuoka (JP); Tsuyoshi Nozaki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 188 days.

(21) Appl. No.: 12/870,372

(22) Filed: Aug. 27, 2010

(65) Prior Publication Data

US 2011/0053077 A1 Mar. 3, 2011

(30) Foreign Application Priority Data

Aug. 28, 2009 (JP) ..... 2009-198102
Oct. 6, 2009 (JP) ..... 2009-232202

(51) Int. Cl.
*G03G 5/00* (2006.01)

(52) U.S. Cl.
USPC ..... 430/137.11; 430/110.2; 430/137.17

(58) Field of Classification Search ..... 430/137.1, 430/137.11, 137.17, 110.2
See application file for complete search history.

(56) References Cited

U.S. PATENT DOCUMENTS 7,550,242 B2 6/2009 Nozaki et al.
7,556,904 B2 7/2009 Kadota et al.
7,556,906 B2 7/2009 Katoh et al.
7,587,159 B2 9/2009 Fuwa et al.
7,632,619 B2 12/2009 Mikuriya et al.
7,635,549 B2 12/2009 Nakamura et al.
7,678,522 B2 3/2010 Nakamura et al.
7,695,885 B2 4/2010 Yasunaga et al.
7,709,171 B2 5/2010 Yamamoto et al.
7,720,428 B2 5/2010 Hagi et al.
7,727,694 B2 6/2010 Murakami et al.
7,749,671 B2 7/2010 Yamamoto et al.
2006/0210904 A1* 9/2006 Ninomiya et al. ..... 430/110.2
2007/0026335 A1 2/2007 Yamamoto et al.
2007/0148568 A1 6/2007 Kadota et al.
2007/0166635 A1 7/2007 Yamamoto et al.
2007/0190443 A1 8/2007 Hagi et al.

(Continued)

FOREIGN PATENT DOCUMENTS

JP 5-333587 12/1993
JP 2006-285188 10/2006

(Continued)

*Primary Examiner* — Stewart Fraser
(74) *Attorney, Agent, or Firm* — Oblon, Spivak, McClelland, Maier & Neustadt, L.L.P.

(57) ABSTRACT

The present invention provides a method for producing a colored resin particle, the method including: preparing an oil phase in which at least a resin and a colorant are dissolved or dispersed in an organic solvent; preparing an aqueous phase containing at least a surfactant in an aqueous medium; dispersing the oil phase in the aqueous phase to prepare a colored particle dispersion liquid so as to form core particles; causing resin fine particles to adhere to surfaces of the core particles by adding at least the resin fine particles to the colored particle dispersion liquid, in which the core particles have been formed; removing the solvent from the colored particle dispersion liquid to obtain colored resin particles, washing the colored resin particles, and drying the colored resin particles, wherein an inorganic base is dissolved in the colored particle dispersion liquid.

17 Claims, 2 Drawing Sheets

U.S. PATENT DOCUMENTS

2007/0207399 A1 9/2007 Kadota et al.
2007/0212630 A1 9/2007 Yasunaga et al.
2007/0217842 A1 9/2007 Kato et al.
2007/0218384 A1 9/2007 Matsumoto et al.
2007/0218388 A1 9/2007 Kurose et al.
2007/0218390 A1 9/2007 Nozaki et al.
2007/0218393 A1 9/2007 Nozaki et al.
2007/0238042 A1 10/2007 Yasunaga et al.
2008/0063957 A1 3/2008 Murakami et al.
2008/0069608 A1 3/2008 Katoh et al.
2008/0069617 A1 3/2008 Matsumoto et al.
2008/0070149 A1 3/2008 Kato et al.
2008/0076054 A1* 3/2008 Nozaki et al. ..... 430/110.2
2008/0081273 A1 4/2008 Murakami et al.
2008/0096119 A1 4/2008 Yamamoto et al.
2008/0101823 A1 5/2008 Katoh et al.
2008/0124635 A1 5/2008 Nakamura et al.
2008/0131797 A1 6/2008 Ishikawa et al.
2008/0131804 A1* 6/2008 Kamiyoshi et al. ..... 430/110.2
2008/0153018 A1 6/2008 Mikuriya et al.
2008/0159777 A1 7/2008 Fuwa et al.
2008/0175630 A1 7/2008 Yasunaga et al.
2008/0176159 A1 7/2008 Matsumoto et al.
2008/0220357 A1 9/2008 Nozaki et al.
2008/0226356 A1 9/2008 Yasunaga et al.
2008/0227001 A1 9/2008 Kadota et al.
2008/0227009 A1 9/2008 Fuwa et al.
2008/0227013 A1 9/2008 Kadota et al.
2008/0227016 A1 9/2008 Nozaki et al.
2008/0232857 A1 9/2008 Matsumoto et al.
2008/0233497 A1 9/2008 Yamamoto et al.
2008/0233506 A1 9/2008 Hagi et al.
2008/0233510 A1 9/2008 Nozaki et al.
2008/0233511 A1 9/2008 Ishikawa et al.
2008/0279591 A1 11/2008 Yasunaga et al.
2009/0017391 A1 1/2009 Yamamoto et al.
2009/0041511 A1 2/2009 Fuwa et al.
2009/0052952 A1 2/2009 Katoh et al.
2009/0117481 A1 5/2009 Yasunaga et al.
2009/0162772 A1 6/2009 Fuwa et al.
2009/0169270 A1 7/2009 Fuwa et al.
2009/0186289 A1 7/2009 Nakamura et al.
2009/0186291 A1 7/2009 Mikuriya et al.
2009/0220879 A1 9/2009 Matsumoto et al.
2009/0232542 A1 9/2009 Yamamoto et al.
2009/0233199 A1 9/2009 Nozaki et al.
2009/0257792 A1 10/2009 Nakamura et al.
2009/0297975 A1 12/2009 Ishikawa et al.
2009/0297976 A1 12/2009 Yamamoto et al.
2010/0009282 A1 1/2010 Katoh et al.
2010/0055603 A1 3/2010 Nozaki et al.
2010/0068646 A1 3/2010 Yamamoto
2010/0150609 A1 6/2010 Nozaki et al.

FOREIGN PATENT DOCUMENTS

JP 4134057 6/2008
JP 2008-191365 8/2008
JP 2008-208354 9/2008

* cited by examiner

COLORED RESIN PARTICLE AND METHOD FOR PRODUCING THE SAME

BACKGROUND OF THE INVENTION

1. Field of the Invention

The present invention relates to a method for producing a colored resin particle usable as a latent electrostatic image-developing toner in electrophotography and having a surface to which resin fine particles are attached, with minimum environmental impact.

Further, the present invention relates to a method for producing a colored resin particle usable in electronic paper and having a surface to which resin fine particles are attached, with minimum environmental impact.

2. Description of the Related Art

In electrophotographic image forming apparatuses, colored resin particles containing a colorant are used as toner for forming visible images. In addition, colored resin particles are also used in forming electronic paper images.

Among various types of toner, there is polymerized toner having a small particle diameter and a narrow particle size distribution.

Further, as a method for producing a toner, in which polyester superior in image fixability can be used as a binder resin (as the main component), there is known a method in which at least a binder resin (e.g., polyester) and a colorant are dissolved or dispersed in an organic solvent to prepare an oil phase, the oil phase is added and dispersed in an aqueous phase containing at least a surfactant, and then the organic solvent is removed from the system to obtain resin particle, followed by washing and drying, thereby obtaining a toner (otherwise, referred to as "dissolution suspension method" hereinbelow).

However, a toner containing polyester as a binder resin main component produced by a dissolution suspension method etc. is unlikely to be charged as compared to a toner containing a styrene acrylic resin as the main component. In particular, in a one-component developing system, toner is frictionally charged by agitation and abrasion with a supplying member (e.g. supplying roller) and a developer bearing member (e.g., developing roller), and abrasion with a regulating member (e.g., a developer bearing member and a regulating blade). As compared to a method called a two-component developing system where toner is mixed with a carrier (e.g., iron powder) with stirring so as to be electrically charged, the one-component developing system has less occasion of being charged, and thus the inferior chargeability is a more significant problem that needs addressing.

In addition, when such a toner produced by a dissolution suspension method is used for forming an electronic paper image, it needs to have flowability of particles in addition to the uniformity of particle size distribution of colored resin particles. However, a colored resin particle obtained in an aqueous system by a dissolution suspension method, etc. is poor in flowability and unsuitable for forming electronic paper images.

To solve the problems described above, various studies have been made. As one of the methods, there has been known a method in which a vinyl-based resin superior in chargeability is caused to be present on a surface of toner.

For example, Japanese Patent Application Laid-Open (JP-A) No. 2006-206851 describes a method in which a vinyl-based resin fine particle-containing dispersion liquid is made present in an aqueous phase, and an oil phase is dispersed in the aqueous phase to produce oil droplets, thereby forming a resin layer of the vinyl-based resin on surfaces of toner particles. The vinyl-based resin described therein contains carboxyl groups derived from methacrylic acids in a large amount, and it can also be considered that the vinyl-based resin functions as such a protective colloid that assists the dispersibility of the oil phase droplets. As a result, it can be considered that a resin layer of the vinyl-based resin can be uniformly formed on surface of the oil phase droplets, however, the moisture absorption property of the toner surface is increased due to the large amount of carboxyl groups held by the toner. Thus, the effect of improving the chargeability is not necessarily sufficient, and the toner does not exhibit satisfactory chargeability, in particular, under high-temperature-high humidity environments. An attempt was made to form a shell-structure of the vinyl-based resin, in which the amount of carboxyl groups had been reduced, in the toner production method described in JP-A No. 2006-206851. As a result, the dispersion stability of oil phase droplets degraded, and resulting particles were coarsely formed, and it was impossible to obtain satisfactory particles usable as toner.

Japanese Patent Application Laid-Open (JP-A) No. 2006-285188 describes a method in which an oil phase is dispersed in an aqueous phase to prepare oil droplets, a vinyl-based resin fine particle-dispersion liquid is charged to the resulting oil droplet dispersion liquid before or after a solved is removed therefrom, followed by heating, thereby making the vinyl-based resin present on surfaces of oil droplets or particles from which the solvent has been removed. In this method, the dispersion liquid is heated at high temperature of 70° C. or higher in order to surely make a vinyl-based resin adhere on particles serving as a core, however, in an actual industrial production, the method needs a significant amount of energy, and therefore, it cannot be said that the method is preferable in consideration of production costs and environmental impact.

Further, Japanese Patent Application Laid-Open (JP-A) No. 2008-208354 describes a method of producing core-shell resin particles.

The description is that when an aqueous dispersion liquid is produced and a resin employed is a resin having a basic functional group (e.g., primary amino group, secondary amino group, tertiary amino group, and quaternary ammonium salt group) (generally, it is preferable that the molecular weight per basic functional group be 1,000 or less), the higher the pH of the aqueous medium, the larger the surface coverage is. It is described that in reverse, the lower the pH of the aqueous medium is, the smaller the surface coverage becomes. As described in JP-A No. 2008-208354, the pH of the aqueous medium can also be adjusted by a water-soluble amine compound, however, a toner produced using the water-soluble amine compound is poor in adhesion of resin fine particles to surfaces of core particles, further and has significantly low chargeability. The resultant toner caused problems due to charge defects in electrophotographic processes. In addition, in the production of the core-shell particles described in JP-A No. 2008-208354, resin fine particles used as a shell agent are added during an emulsification treatment, however, when a shell agent is added during an emulsification treatment, the amount of the resin fine particles introduced into cores is increased, and thus it is difficult to uniformly disperse resin fine particles on core surfaces.

Japanese Patent Application Laid-Open (JP-A) No. 05-333587 discloses a toner which is produced by granulating particles composed of a polyester resin and a colorant in a wet process, and subjecting the granulated particles to flocculation, drying, and fusing processes, in which fine particles (charged particles) containing styrene/butyl-acrylate at a compositional ratio (80/20) are fixed to the surface of the toner, in the light of controlling chargeability of toner. However, the toner disclosed in JP-A No. 05-333587 is obtained through granulation of particles in a wet process, granulation, and fusing the dried production by a pulverizer, and the fine particles are not uniformly present on the toner surface. Therefore, it cannot be said that the toner is sufficient in charge stability.

Typically, in a production of a granulated toner, a polyester resin, a polyamine compound and other materials (e.g., colorant, releasing agent, charge controlling agent, and viscosity adjusting agent) are dissolved/dispersed in an organic solvent to prepare an oil phase; and an aqueous phase containing a low-molecular weight activator and a high-molecular weight dispersant such as an organic resin fine particle is prepared. Then, the oil phase and the aqueous phase are mixed and stirred (emulsification step) so that the oil phase is dispersed in the aqueous phase to thereby obtain toner particles while granulating oil phase particles. However, there has been a problem in that when additional resin fine particles are attached onto a surface layer of the granulated toner particles, the adhesion of particles to the surface layer becomes non-uniform due to the polyamine compound contained therein and the resin fine particles are not uniformly attached to the surface of the toner particles.

Further, when a vinyl-based resin is charged to the dispersion mixture from which the solvent has not been removed and when a vinyl-based group, which contains less polar groups such as carboxyl group, the dispersion stability of oil droplets degrades and thus the oil droplets aggregate and coalesce with each other. As a result, it was impossible to obtain satisfactory particles usable as toner.

BRIEF SUMMARY OF THE INVENTION

The present invention aims to provide a method for producing a colored resin particle, which can be suitably used as a latent electrostatic image-developing toner for electrophotography and as an electronic paper colored resin particle, the method enabling efficiently making resin fine particles adhere on surface of particles with minimum impact on production environments The present inventors have carried out extensive studies and have found that in a method for producing a colored resin particle, the method including at least: preparing an oil phase in which at least a resin and a colorant are dissolved or dispersed in an organic solvent; preparing an aqueous phase containing at least an inorganic base and a surfactant in an aqueous medium; dispersing the oil phase in the aqueous phase to prepare a dispersion liquid in which core particles of the oil phase are dispersed; adding a resin fine particle-dispersion liquid into the dispersion liquid so that the fine resin particles adhere to the core particles, it is possible to efficiently make the resin fine particles adhere to the particle surfaces and to produce a colored resin particle which can be suitably used as a latent electrostatic image-developing toner for electrophotography, with minimum impact on production environments. This finding leads the present inventors to achieve the present invention.

The present invention is based on the finding by the present inventors, and means for solving the above-mentioned problems are as follows.

<1> A method for producing a colored resin particle, the method including:

preparing an oil phase in which at least a resin and a colorant are dissolved or dispersed in an organic solvent, preparing an aqueous phase containing at least a surfactant in an aqueous medium, dispersing the oil phase in the aqueous phase to prepare a colored particle dispersion liquid so as to form core particles, causing resin fine particles to adhere to surfaces of the core particles by adding at least the resin fine particles to the colored particle dispersion liquid, in which the core particles have been formed, removing the solvent from the colored particle dispersion liquid to obtain colored resin particles, washing the colored resin particles, and drying the colored resin particles, wherein an inorganic base is dissolved in the colored particle dispersion liquid.

<2> The method for producing a colored resin particle, according to <1> above, wherein the resin fine particles have a volume average particle diameter of 60 nm to 120 nm.

<3> The method for producing a colored resin particle, according to <1> above, wherein the resin fine particles comprise a vinyl-based resin.

<4> The method for producing a colored resin particle, according to <1> above, wherein in the causing the resin fine particles to adhere to the surfaces of the core particles, a vinyl-based resin fine particle dispersion liquid is introduced to the dispersion liquid to cause the resin fine particles to adhere to the surfaces of the core particles, and wherein the vinyl-based resin fine particle dispersion liquid contains vinyl-based resin fine particles dispersed in an aqueous medium, and wherein the vinyl-based resin fine particles are obtained by polymerization of a monomer mixture containing a compound having a vinyl polymerizable functional group and an acid group in an amount of 0% by mass to 7% by mass and an aromatic compound having at least a vinyl polymerizable functional group.

<5> The method for producing a colored resin particle, according to <4> above, wherein the compound having a vinyl polymerizable functional group and an acid group is contained in an amount of 0% by mass in the monomer mixture.

<6> The method for producing a colored resin particle, according to <4> above, wherein the aromatic compound having a vinyl polymerizable functional group is contained in an amount of 80% by mass or more in the monomer mixture.

<7> The method for producing a colored resin particle, according to <4> above, wherein the aromatic compound having a vinyl polymerizable functional group is contained in an amount of 95% by mass or more in the monomer mixture.

<8> The method for producing a colored resin particle, according to <4> above, wherein the aromatic compound having a vinyl polymerizable functional group is styrene.

<9> The method for producing a colored resin particle, according to <3> above, wherein the vinyl-based resin contains a styrene-based monomer in an amount of 80% by mass or more.

<10> The method for producing a colored resin particle, according to <1> above, wherein the inorganic base is added in the preparing the aqueous phase or the preparing the oil phase.

<11> The method for producing a colored resin particle, according to <1> above, wherein the washing of the colored resin particle is a washing treatment with an acid.

<12> The method for producing a colored resin particle, according to <1> above, wherein the resin has an acid value of from 2 mgKOH/g to 26 mgKOH/g.

<13> The method for producing a colored resin particle, according to <1>, wherein the resin is a polyester resin.

<14> The method for producing a colored resin particle, according to <1>, wherein a modified resin having an isocyanate group at a terminal thereof is dissolved in the oil phase.

<15> The method for producing a colored resin particle, according to <14>, wherein the modified resin has a polyester skeleton.

<16> The method for producing a colored resin particle, according to <1>, wherein the colored resin particle contains no amine compound having an active hydrogen-containing group.

<17> A colored resin particle including:

a resin, and a colorant, wherein the colored resin particle is obtained by a method for producing a colored resin particle, the method comprises:

preparing an oil phase in which at least the resin and the colorant are dissolved or dispersed in an organic solvent, preparing an aqueous phase containing at least a surfactant in an aqueous medium, dispersing the oil phase in the aqueous phase to prepare a colored particle dispersion liquid so as to form core particles, causing resin fine particles to adhere to surfaces of the core particles by adding at least the resin fine particles to the colored particle dispersion liquid, in which the core particles have been formed, removing the solvent from the colored particle dispersion liquid to obtain colored resin particles, washing the colored resin particles, and drying the colored resin particles, and wherein an inorganic base is dissolved in the colored particle dispersion liquid.

<18> A toner containing:

a colored resin particle, wherein the colored resin particle is obtained by a method for producing a colored resin particle, the method comprises:

preparing an oil phase in which at least a resin and a colorant are dissolved or dispersed in an organic solvent, preparing an aqueous phase containing at least a surfactant in an aqueous medium, dispersing the oil phase in the aqueous phase to prepare a colored particle dispersion liquid so as to form core particles, causing resin fine particles to adhere to surfaces of the core particles by adding at least the resin fine particles to the colored particle dispersion liquid, in which the core particles have been formed, removing the solvent from the colored particle dispersion liquid to obtain colored resin particles, washing the colored resin particles, and drying the colored resin particles, and wherein an inorganic base is dissolved in the colored particle dispersion liquid.

<19> An image forming method including:

uniformly charging a surface of a latent image bearing member, exposing the charged surface of the latent image bearing member based on image data so as to write a latent electrostatic image thereon, forming a developer layer formed of a developer having a predetermined layer thickness on a developer bearing member by a developer layer-regulating member so as to develop the latent electrostatic image that has been formed on the surface of the latent image bearing member via the developer layer, and to form a visible image, transferring the visible image on the latent image bearing member onto an image transfer medium, and fixing the visible image on the image transfer medium, wherein the developer comprises a latent electrostatic image-developing toner which comprises a colored resin particle, wherein the colored resin particle is obtained by a method for producing a colored resin particle, the method comprises:

preparing an oil phase in which at least a resin and a colorant are dissolved or dispersed in an organic solvent, preparing an aqueous phase containing at least a surfactant in an aqueous medium, dispersing the oil phase in the aqueous phase to prepare a colored particle dispersion liquid so as to form core particles, causing resin fine particles to adhere to surfaces of the core particles by adding at least the resin fine particles to the colored particle dispersion liquid, in which the core particles have been formed, removing the solvent from the colored particle dispersion liquid to obtain colored resin particles, washing the colored resin particles, and drying the colored resin particles, and wherein an inorganic base is dissolved in the colored particle dispersion liquid.

<20> A process cartridge including:

a latent electrostatic image bearing member, and a developing unit configured to develop a latent electrostatic image formed on the latent electrostatic image bearing member using a toner to form a visible image, wherein the process cartridge is detachably mounted to a main body of an image forming apparatus, wherein the toner is a latent electrostatic image-developing toner which comprises a colored resin particle, wherein the colored resin particle is obtained by a method for producing a colored resin particle, the method comprises:

preparing an oil phase in which at least a resin and a colorant are dissolved or dispersed in an organic solvent, preparing an aqueous phase containing at least a surfactant in an aqueous medium, dispersing the oil phase in the aqueous phase to prepare a colored particle dispersion liquid so as to form core particles, causing resin fine particles to adhere to surfaces of the core particles by adding at least the resin fine particles to the colored particle dispersion liquid, in which the core particles have been formed, removing the solvent from the colored particle dispersion liquid to obtain colored resin particles, washing the colored resin particles, and drying the colored resin particles, and wherein an inorganic base is dissolved in the colored particle dispersion liquid.

According to the method for producing a colored resin particle of the present invention, it is possible to efficiently and uniformly make resin fine particles adhere on core particles without their undergoing heating process and to obtain a colored resin particle excellent in charge stability and suitable for a latent electrostatic image-developing toner and formation of electronic paper images.

DETAILED DESCRIPTION OF THE INVENTION

Figure 1:
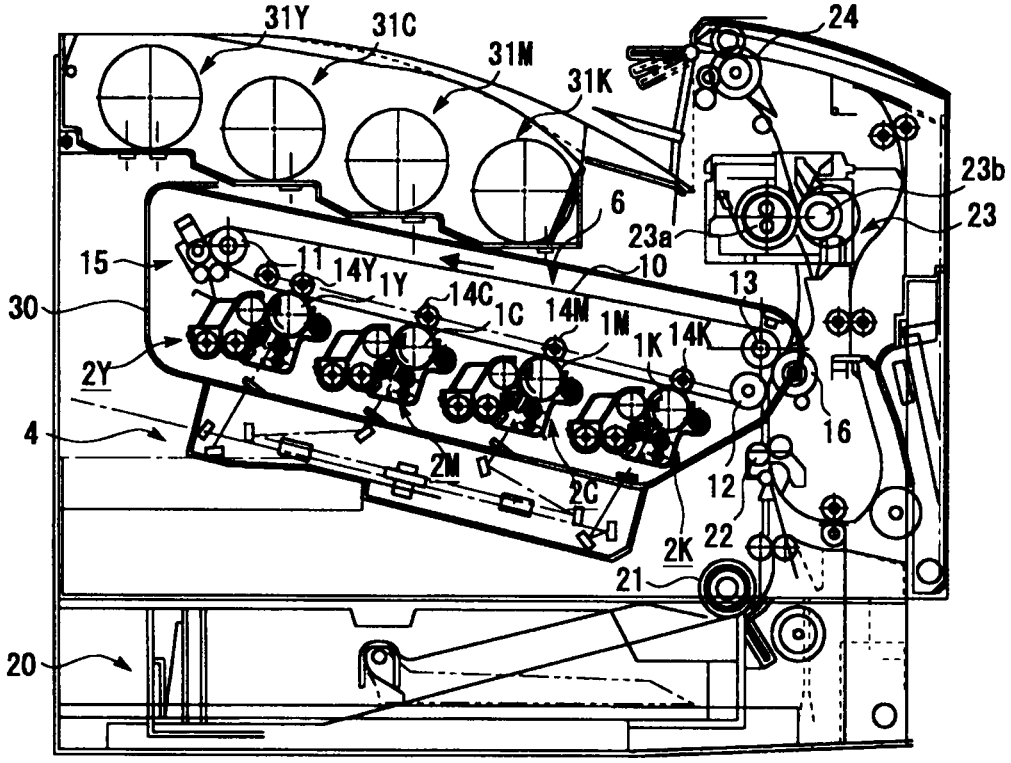
FIG. 1 is a schematic cross-sectional diagram exemplarily illustrating a structure of an image forming apparatus according to an embodiment of the present invention.

A method for producing a colored resin particle according to the present invention includes at least preparing an oil phase in which at least a resin and a colorant are dissolved or dispersed in an organic solvent; preparing an aqueous phase containing at least a surfactant in an aqueous medium; dispersing the oil phase in the aqueous phase to prepare a colored particle dispersion liquid so as to form core particles; adding at least resin fine particles in the colored particle dispersion liquid, in which the core particles have been formed, so that the resin fine particles are caused to adhere to surfaces of the core particles, removing the solvent from the colored particle dispersion liquid to obtain colored resin particles, washing the colored resin particles, and drying the colored resin particles, and further includes other steps as required.

A colored resin particle according to the present invention is produced by the method for producing a colored resin particle of the present invention.

Hereinafter, the colored resin particle of the present invention will be described in detail through the description of the method for producing a colored resin particle of the present invention.

<Resin Fine Particles Made to Adhere to Surfaces of Core Particles>

Typical examples of resin fine particles for use in the present invention include a polyester resin; a vinyl-based resin obtained by polymerization of a monomer mixture containing at least a styrene-based monomer; or a hybrid resin containing a vinyl resin component in a skeleton of a polyester resin. The resin fine particles preferably selected in consideration of solubility with a wax to be dispersed near the surface layer of toner.

More specifically, in order to use a colored resin particle obtained in the present invention as a particle which is effectively active by electrically charging, such as a latent electrostatic image-developing toner, it is preferable that the colored resin particle has, as tits surface, a structure easily electrically chargeable. To this end, it is preferable to use a styrene-based having an electronic orbital structure where electrons can be stably present, like an aromatic ring structure, in an amount of 50% by mass to 100% by mass, preferably in an amount of 80% by mass to 100% by mass, and more preferably 95% by mass to 100% by mass, in the monomer mixture. When the amount of the styrene-based monomer is less than 50% by mass, the chargeability of the resulting cored resin particle becomes poor, which limits the application purpose of the cored resin particle.

In addition, the important thing when the resin fine particles are added in the colored resin dispersion liquid is to select an average particle diameter of the resin fine particles.

In the present invention, when resin fine particles are added to surfaces of core particles, the volume average particle diameter of the resin fine particles is controlled to be from 60 nm to 120 nm, preferably from 60 nm to 110 nm, and more preferably from 60 nm to 100 nm. The particle diameter of the resin fine particles is greater than 120 nm, the rate of forming particles with only the resin fine particles increases during the formation of particles, resulting in a degradation of uniformity of resin fine particles to be dispersed on surfaces of core particles. In contrast, when the particle diameter is smaller than 60 nm, aggregability of single body of resin fine particles degrades and the rate of suspended particles that do not adhere on the surfaces of core particles increases, resulting in a degradation of uniformity of resin fine particles to be dispersed on surfaces of core particles.

For this reason, in the present invention, as a method for uniformly dispersing the resin fine particles on the surfaces of core particles, an inorganic base is used in place of an amine compound, and the particle diameter of the resin fine particles is controlled to be within a predetermined range, whereby the resin fine particles can be uniformly dispersed on the surfaces of core particles.

Here, the term "styrene-based monomer" means an aromatic compound having a vinyl polymerizable functional group. Examples of the polymerizable functional group include vinyl group, isopropenyl group, allyl group, acryloyl group, and methacryloyl group.

Examples of the styrene-based monomer include styrene, α-methylstyrene, 4-methylstyrene, 4-ethylstyrene, 4-tert-butylstyrene, 4-methoxystyrene, 4-ethoxystyrene, 4-carboxystyrene or metal salts thereof, 4-styrene sulfonic acid or metal salts thereof, 1-vinylnaphthalene, 2-vinylnaphthalene, allylbenzene, phenoxy alkylene glycol acrylate, phenoxy alkylene glycol methacrylate, phenoxy polyalkylene glycol acrylate, and phenoxy polyalkylene glycol methacrylate.

Among these styrene-based monomers, it is preferable to mainly use styrene which is easily available, excellent in reactivity and has high chargeability.

In the vinyl-based resin preferably used in the present invention, an acid monomer is used in an amount of from 0% by mass to 7% by mass, preferably in an amount of from 0% by mass to 4% by mass in the monomer mixture, and it is more preferable that no acid monomer be used in the monomer mixture. When the acid monomer is used in an amount more than 7% by mass, the resulting vinyl-based resin fine particle itself tends to have high dispersion stability, and thus the resulting vinyl-based resin fine particle rarely adhere on surfaces of core particles at normal temperature or easily desorbs therefrom although adhered thereto even when the vinyl-based resin fine particle is added in a dispersion liquid in which the oil phase is dispersed in the aqueous phase. As a result, the vinyl-based resin fine particle is easily peeled off from the surface of core particles in the course of performing desolvation, washing, and external addition processes. A change in chargeability of the resulting colored resin particle can be reduced, depending on the environment in which it is used, by controlling the addition amount of the acid monomer to 4% by mass or less.

Here, the term "acid monomer" means a compound having a vinyl polymerizable functional group and an acid group. Examples of the acid group include a carboxylic acid group, a sulfonic acid group, and a phosphonic acid group.

Examples of the acid monomer include a carboxyl group-containing vinyl-based monomer or salts thereof (e.g., (meth) acrylic acid, maleic acid (anhydride), monoalkyl maleate, fumaric acid, monoalkyl fumarate, crotonic acid, itaconic acid, monoalkyl itaconate, itaconic acid glycol monoether, citraconic acid, monoalkyl citrate, and cinnamic acid); a sulfonic acid group-containing vinyl-based monomer, a vinyl-based sulfuric acid monoester or salts thereof; a phosphoric acid group-containing vinyl-based monomer or salts thereof. Among these acid monomers, (meth)acrylic acid, maleic acid (anhydride), monoalkyl maleate, fumaric acid, monoalkyl fumarate are particularly preferable.

The method of obtaining vinyl-based resin fine particles is not particularly limited and may be suitably selected in accordance with the intended use. For example the following methods (a) to (f) are exemplified:

(a) a monomer mixture is subjected to a polymerization reaction (e.g., suspension polymerization, emulsification polymerization, seed polymerization or dispersion polymerization) to produce a dispersion liquid containing vinyl-based resin fine particles;

(b) a monomer is previously polymerized to obtain a resin, the resin thus obtained is pulverized by a mechanically rotatable or jet micropulverizer, and then subjected to classification, thereby producing resin fine particles;

(c) a monomer is previously polymerized to obtain a resin, the resin thus obtained is dissolved in a solvent to prepare a resin solution, and the resin solution is sprayed, thereby producing resin fine particles;

(d) a monomer is previously polymerized to obtain a resin, the resin thus obtained is dissolved in a solvent to prepare a resin solution, and a solvent is added to the resin solution, or a resin solution which has been previously heat dissolved in a solvent is cooled so as to precipitate resin fine particles, followed by desolvation, thereby producing resin fine particles;

(e) a monomer mixture is previously polymerized to obtain a resin, the resin thus obtained is dissolved in a solvent to prepare a resin solution, the resin solution is dispersed in an aqueous medium in the presence of an appropriate dispersant, and the resulting dispersion liquid is subjected to desolvation by heating, vacuum pressure or the like, thereby producing resin fine particles; and (f) a monomer mixture is previously polymerized to obtain a resin, the resin thus obtained is dissolved in a solvent to prepare a resin solution, an appropriate emulsifier is dissolved in the resin solution, and water is added to the resin solution to cause a phase inversion, thereby producing resin fine particles.

Among these methods, the method (a) whereby resin fine particles are easily obtained in the formed of a dispersion liquid and thus application to the subsequent process can be smoothly carried out is preferable.

When a polymerization reason is performed by the method (a), it is preferable that a dispersion stabilizer be added in an aqueous medium, or a monomer (a so-called reactive emulsifier) capable of imparting dispersion stability to resin fine particles obtained by polymerization be added in a monomer to be polymerized, or these two methods are used in combination, thereby imparting dispersion stability to the resulting vinyl-based resin fine particles. When a dispersion stabilizer and/or a reactive emulsifier do not used, undesirably, the dispersion state of the particles cannot be stably maintained, and thus, vinyl-based resin cannot be obtained in the form of fine particles, the resulting resin fine particles are poor in storage stability due to their low dispersion stability, causing aggregation during storage, or the dispersion stability of particles degrades in the after-mentioned resin fine particle-attaching step and thus core particles easily aggregate and coalesce with each other, resulting in a degradation of particle diameter, particle shape, surface configuration of the finally obtained cored resin fine particles.

As the dispersion stability, a surfactant and an inorganic dispersant are exemplified. Examples of the surfactant include anionic surfactants (e.g., alkylbenzene sulfonic acid salt, α-olefin sulfonic acid salt, and phosphoric acid ester); amine salt type surfactants (e.g., alkylamine salts, aminoalcohol fatty acid derivatives, polyamine fatty acid derivatives and imidazoline); quaternary ammonium salt type cationic surfactants (e.g., alkyltrimethyl ammonium salts, dialkyldimethyl ammonium salts, alkyldimethylbenzyl ammonium salts, pyridinium salts, alkyl isoquinolinium salts, and benzethonium chloride); nonionic surfactants (e.g., fatty acid amide derivatives, and polyhydric alcohol derivatives); and amphoteric surfactants (e.g., alanine, dodecyldi(aminoethyl) glycine, di(octylaminoethyl)glycine, and N-alkyl-N,N-dimethyl ammonium betaine).

Examples of the inorganic dispersants include tricalcium phosphate, calcium carbonate, titanium oxide, colloidal silica, and hydroxy apatite.

When the cored resin fine particle of the present invention is produced, it is possible to use a typically used chain transfer agent with a view to adjusting the molecular weight thereof. The chain transfer agent is not particularly limited, however, it is preferable to use a hydrocarbon group-containing alkyl mercaptan-based chain transfer agent having 3 or more carbon atoms.

Such a hydrophobic chain transfer agent like the hydrocarbon group-containing alkyl mercaptan-based chain transfer agent having 3 or more carbon atoms is not particularly limited and may be suitably selected in accordance with the intended use. Examples thereof include butanethiol, octanethiol, decanethiol, dodecanethiol, hexadecanethiol, octadecane hexadecanethiol, cyclohexyl mercaptan, thiophenol, octyl thioglycolate, octyl 2-mercaptopropionate, octyl 3-mercaptopropionate, 2-ethylhexyl mercaptopropionate, 2-mercaptoethyl octanoate, 1,8-dimercapto-3,6-dioxaoctane, decanetrithiol, and dodecylmercaptan. In the polymerization reaction, these hydrophobic chain transfer agents may be used alone or in combination.

The addition amount of the chain transfer agent is not particularly limited, as long as it is the amount by which the resulting copolymer has a desired molecular weight. It is, however, preferably 0.01 parts by mass to 30 parts by mass, and more preferably 0.1 parts by mass to 25 parts by mass relative to the total moles of monomer components. At this time, when the addition amount of the chain transfer agent is less than 0.01 parts by mass, the molecular weight of the resulting copolymer excessively increased, and thus the fixability may degrade, and the dispersion liquid may gelatinized during the polymerization reaction. In contrast, when the addition amount of the chain transfer agent is more than 30 parts by mass, the chain transfer agent remains unreacted, and the molecular weight of the resulting copolymer becomes too low, causing contamination of members used.

<Resin to be Added in Organic Solvent>

As the resin to be added in an organic solvent, a resin, at least part of which is dissolved in an organic solvent is used, and the acid value of the resin is preferably from 2 mgKOH/g to 26 mgKOH/g. When the acid value is more than 26 mgKOH/g, problems tend to occur, such as the resin easily transfers to the aqueous phase, resulting in a loss of mass balance in the course of production process, or the dispersion stability of oil droplets degrades. In contrast, when the acid value of the resin is less than 2 mgKOH/g, the polarity of the resin decreases, and thus it becomes difficult to uniformly disperse a colorant having a certain polarity in oil droplets.

The type of the resin is not particularly limited, however, when the resin is used in a latent electrostatic image-developing toner in electrophotography, it is preferable to use a resin having a polyester skeleton, because excellent fixability can be obtained. As the resin having a polyester skeleton, a polyester resin and a block polymer of polyester with a resin having another skeleton are exemplified. Among these, it is preferable to use a polyester resin, because the uniformity of the resulting colored resin particle is high.

Examples of the polyester resin include ring-opening polymers of lactones, polycondensates of hydroxycarboxylic acid, and polycondensates of polyol with polycarboxylic acid. Among these, polycondensates of polyol with polycarboxylic acid are preferable from the viewpoint of the freedom degree of design.

The peak molecular weight of the polyester resin is usually from 1,000 to 30,000, preferably from 1,500 to 10,000, and still more preferably 2,000 to 8,000. When the peak molecular weight is less than 1,000, the heat resistant storage stability may degrade. When it is more than 30,000, the low-temperature fixability of the resulting toner (as a latent electrostatic image-developing toner) may degrade.

The glass transition temperature of the polyester resin is in the range of from 35° C. to 80° C., preferably from 40° C. to 70° C., and more preferably from 45° C. to 65° C. When the glass transition temperature is lower than 35° C., the resulting colored resin particle is deformed when placed under high temperature environments, especially in the middle of summer, or colored resin particles stick to each other and may not behave as a cored resin particle. When the glass transition temperature of the polyester resin is higher than 80° C., the fixability degrades when the cored resin particle is used as a latent electrostatic image-developing toner.

The following describes polyol and carboxylic acids for use in producing the polyester resin.

(Polyol)

As polyol (1), diol (1-1) and trihydric or higher polyhydric polyol (1-2) are exemplified. A single use of the diol (1) or a mixture of the diol (1-1) with a small amount of the trihydric or higher polyhydric polyol (1-2) is preferable.

The following are examples of the diol (1-1).

Alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropyleneglycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclicdiols mentioned above with an alkylene oxide (e.g., ethylene oxide, propylene oxide and butylene oxide); 4,4'-dihydroxybiphenyls (e.g., 3,3-difluoro-4,4'-dihydroxybiphenyl); bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also known as: tetrafluorobisphenol A), and 2,2-bis(3-hydroxyphenyl)-1,1,1,3,3,3-hexafluoropropane); bis(4-hydroxyphenyl)ethers (e.g., bis(3-fluoro-4-hydroxyphenyl)ether; and adducts of the bisphenols mentioned above with an alkylene oxide (e.g., ethylene oxide, propylene oxide, and butylene oxide).

Among these compounds, alkylene glycols having 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having 2 to 12 carbon atoms are used.

The following are examples of the trihydric or higher polyhydric polyol (1-2).

Trihydric to octahydric or higher polyhydric aliphatic alcohols (e.g., glycerin, trimethylolethane, trimethyloipropane, pentaerythritol, and sorbitol); trihydric and higher phenols (e.g., trisphenol PA, phenol novolac, and cresol novolac); and adducts of the above-mentioned trihydric or higher polyphenols mentioned with an alkylene oxide.

(Polycarboxylic Acid)

As polycarboxylic acid (2), dicarboxylic acid (2-1) and trivalent or higher polycarboxylic acid (2-2) are exemplified. A single use of the dicarboxylic acid (2-1) or a mixture of the dicarboxylic acid (2-1) with a small amount of the trivalent or higher polycarboxylic acid (2-2) is preferable.

Examples of the dicarboxylic acid (2-1) include alkylene dicarboxylic acids (e.g., succinic acid, adipic acid, and sebacic acid); alkenylene dicarboxylic acids (e.g., maleic acid and fumaric acid); and aromatic dicarboxylic acids (e.g., phthalic acid, isophthalic acid, terephthalic acid, naphthalene dicarboxylic acid); 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2, 2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidene diphthalic anhydride). Among these compounds, an alkenylene dicarboxylic acid having 4 to 20 carbon atoms, and an aromatic dicarboxylic acid having 8 to 20 carbon atoms are preferred.

As the trivalent or higher polycarboxylic acid (2-2), aromatic polycarboxylic acid having 9 to 20 carbon atoms (e.g., trimellitic acid and pyromellitic acid) are exemplified. As the polycarboxylic acid (2), an acid anhydride or a lower alkyl ester (such as a methyl ester, ethyl ester, or isopropyl ester) described above can be used as a trivalent or higher polycarboxylic acid to react with the polyol (1).

The ratio of the polyol (1) to the polycarboxylic acid (2), as the equivalent ratio [OH]/[COOH] of hydroxyl groups [OH] to carboxyl groups [COOH], is usually from 2/1 to 1/2, preferably from 1.5/1 to 1/1.5, and more preferably from 1.3/1 to 1/1.3.

<Modified Resin>

For the purpose of increasing the mechanical strength of the resulting cored resin particle and when the cored resin particle is used as a latent electrostatic image-developing toner, preventing high-temperature offset in fixation of images, in addition to increasing the mechanical strength, a modified resin having an isocyanate group in its terminal may be dissolved in the oil phase to thereby obtain the cored resin particle. Examples of the method of obtaining the modified resin include a method in which a polyester resin is subjected to a polymerization reaction together with a monomer containing an isocyanate to thereby obtain a resin having an isocyanate group; and a method in which a resin having an active hydrogen in its terminal is obtained by polymerization and then the resin is reacted with a polyisocyanate to thereby introduce an isocyanate group into the terminal of polymer. Of these two methods, the latter method is preferably employed in terms of the controllability of introducing an isocyanate group into the terminal of polymer. Examples of the active hydrogen include a hydroxyl group (e.g., alcoholic hydroxyl group, and phenolic hydroxyl group), an amino group, a carboxyl group, and a mercapto group. Among these groups, an alcoholic hydroxyl group is preferable. As a skeleton of the modified resin, it is preferable to use the same skeleton of the resin to be dissolved in the organic solvent, in consideration of the uniformity of the resulting resin particle, and thus preferably, the modified resin has a polyester skeleton. As a method of obtaining a resin having an alcoholic hydroxyl group in the terminal of polyester, in the polycondensation of the polyol and the polycarboxylic acid, it is advisable to increase the number of functional groups of the polyol higher than the number of functional groups of the polycarboxylic acid.

<Inorganic Base>

As the inorganic base used for controlling the hydrogen ion concentration index of a system used in the core particle preparation step, a known inorganic base can be used. Specific examples of the inorganic based include hydroxides (e.g., lithium hydroxide, sodium hydroxide, potassium hydroxide, cesium hydroxide, magnesium hydroxide, and calcium hydroxide); carbonates (e.g., lithium carbonate, sodium carbonate, potassium carbonate, cesium carbonate, magnesium carbonate, and calcium carbonate); an ammonia solution, and mixtures of arbitrarily selected therefrom. The inorganic base may be used in one of the oil phase and the aqueous phase. The resin phase serving as a toner component is previously impregnated with the inorganic base by adding the inorganic base into the oil phase, thereby making it possible to improve the uniformity of particles, granulability in an emulsification process, productivity of core particles and adhesion of resin fine particles in a convergence process. The pH of the aqueous phase can be adjusted to be alkaline by adding the inorganic base into the aqueous phase, and thereby the particle diameter can be finely adjusted in the emulsification process. Note that an effect substantially the same as described above can be obtained by adding the inorganic base in the oil phase, which is then mixed with the aqueous phase. The pH of the aqueous phase can also be adjusted with a water-soluble organic amine compound, however, a toner produced using the water-soluble amine compound unfavorably causes a degradation in adhesion properties of resin fine particles on surfaces of core particles and further causes a considerable degradation in chargeability, and thus it becomes very difficult to use the toner in electrophotographic processes.

Note that the "organic amine compound" mentioned above is an amine compound having an N—C bond, and encompasses triethylamine, isophoronediamine, and ethanolamine.

<Organic Solvent>

As the organic solvent, a volatile organic solvent having a boiling point of less than 100° C. is preferable from the viewpoint of ease of removing of the solvent after formation of toner base particles. Specific examples of the organic solvent include toluene, xylene, benzene, tetrachloride carbon, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These can be used alone or in combination. When the resin to be dissolved or dispersed in an organic solvent is a resin having a polyester skeleton, it is preferable to use an ester-based solvent (e.g., methyl acetate, ethyl acetate, and butyl acetate) or a ketone-based solvent (e.g., methyl ethyl ketone and, methyl isobutyl ketone) because the resin is highly soluble in the solvent. Among these organic solvents, methyl acetate, ethyl acetate and methyl ethyl ketone are particularly preferable for their high removability.

<Aqueous Medium>

As the aqueous medium, water may be singularly used but a solvent miscible with water may also be used in combination with water. Examples of the solvent miscible with water include alcohols (e.g., methanol, isopropanol, ethylene glycol), dimethylformamide, tetrahydrofuran, cellosolves (e.g., methylcellosolve) and lower ketones (e.g., acetone, and methyl ethyl ketone).

<Surfactant>

A surfactant is used for dispersing an oil phase in the aqueous medium to produce liquid droplets.

Examples of the surfactant include anionic surfactants (e.g., alkylbenzene sulfonate, α-olefin sulfonate, and phosphate ester); cationic surfactants such as amine salt surfactant (e.g., alkylamine salt, amino alcohol fatty acid derivative, polyamine fatty acid derivative, and imidazoline), and quaternary ammonium salt (e.g., alkyl trimethyl ammonium salt, dialkyldimethyl ammonium salt, alkyl dimethylbenzyl ammonium salt, pyridinium salt, alkyl isoquinolinium salt, and benzethonium chloride); nonionic surfactants (e.g., fatty acid amide derivative, and polyhydric alcohol derivative); and zwitterionic surfactants (e.g., alanine, dodecyldi(aminoethyl) glycine, di(octylaminoethyl)glycine, and N-alkyl N,N-dimethylammonium betaine). With use of a surfactant having a fluoroalkyl group, the dispersed state of the above-mentioned materials can be improved with a small amount.

Preferred examples of the anionic surfactant having a fluoroalkyl group include fluoroalkyl carboxylic acid having a carbon atoms of 2 to 10 or metal salt thereof, disodium perfluorooctane sulfonyl glutamic acid, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid or its metal salt, perfluoroalkyl carboxylic acid (C7 to C13) or its metal salt, perfluoroalkyl (C4 to C12) sulfonate or its metal salt, perfluorooctane sulfonic acid diethanolamide, N-propyl-N-(2-hydroxyethyl)perfluorooctane sulfonamide, perfluoroalkyl (C6 to C10) sulfonamide propyl trimethyl ammonium salt, perfluoroalkyl (C6 to C10)-N-ethylsulfonyl glycine salt, and mono perfluoroalkyl (C6 to C16) ethylphosphate ester. Examples of the cationic surfactant include aliphatic primary, secondary, or tertiary amine having a fluoroalkyl group, aliphatic quaternary ammonium salt, such as perfluoroalkyl (C6 to C10) sulfonamide propyl trimethyl ammonium salt, benzalkonium salt, benzethonium chloride, pyridinium salt, and imidazolinium salt.

<Inorganic Dispersant>

A solution or dispersion of a toner composition may be dispersed in the above-mentioned aqueous medium in which an inorganic dispersant is or resin fine particles are present. As the inorganic dispersant, tricalcium phosphate, calcium carbonate, titanium oxide, colloidal silica, and hydroxyapatite can be used. It is preferable to use a dispersant in that a sharper particle size distribution and a stable dispersion can be obtained.

<Protective Colloid>

Further, a polymer-based protective colloid may be used to stabilize dispersion liquid droplets.

Specific usable examples thereof include acids (e.g., acrylic acid, methacrylic acid, a-cyanoacrylic acid, a-cyanomethacrylic acid, itaconic acid, crotonic acid, fumaric acid, maleic acid, and maleic anhydride); (meth)acrylic monomer having hydroxyl group (e.g., β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl acrylic acid, 3-chloro-2-hydroxypropyl methacrylic acid, diethylene glycol monoacrylic ester, diethylene glycol monomethacrylic acid ester, glycerin monoacrylic ester, glycerin monomethacrylic ester, N-methylol acrylamide, and N-methylol methacrylamide); vinyl alcohols or vinyl alcohol ethers (e.g., vinyl methyl ether, vinyl ethyl ether, and vinyl propyl ether); ester compounds having vinyl alcohol and carboxyl group (e.g., vinyl acetate, vinyl propionate, and vinyl butyrate); acrylamide, methacrylamide, diacetone acrylamide or methylol compound thereof; acid chlorides (e.g., acrylic acid chloride, and methacrylic acid chloride); homopolymers or copolymers having nitrogen atoms or a heterocyclic ring of nitrogen atom (e.g., vinylpyridine, vinylpyrrolidone, vinylimidazole, and ethyleneimine); polyoxyethylene compounds (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, and polyoxyethylene nonyl phenyl ester); and celluloses (e.g., methyl cellulose, hydroxyethyl cellulose, and hydroxypropyl cellulose).

Note that when an acid such as calcium phosphate or an alkali-soluble compound is used as a dispersion stabilizer, calcium phosphate is removed from fine particles by a method in which the calcium phosphate is dissolved by an acid (e.g., hydrochloric acid) and then washed with water. Besides, the calcium phosphate can also be removed by decomposition with enzyme. When a dispersant is used, the dispersant may remain on surfaces of toner particles, however, from the view point of chargeability of toner, it is preferable to wash out and remove the dispersant after chain-extending and/or crosslinking reaction.

<Colorant>

As the colorant, any known dyes and pigments can be used. Specific usable colorants include but not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and mixtures thereof.

<Masterbatch of Colorant>

A colorant for use in the present invention can also be used as a masterbatch compounded with a resin.

Examples of a binder resin to be used in production of a masterbatch or kneaded together with a masterbatch, besides the above-mentioned modified or unmodified polyester resin, include styrene or polymers of substitution product thereof (e.g., polystyrene, poly(p-chlorostyrene), and polyvinyltoluene); styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer); polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic resin, rosin, modified rosin, terpene resin, aliphatic hydrocarbon resin, alicyclic hydrocarbon resin, aromatic resin, chlorinated paraffin, and paraffin wax. These may be used alone or in combination.

<Production Method of Masterbatch>

The masterbatch can be obtained by mixing and kneading the resin for masterbatch and the colorant under application of high shear force. On that occasion, it is possible to use an organic solvent to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because a wet cake of the colorant may be directly used without drying the cake. For the mixing and kneading, a high-shearing dispersion apparatus such as a triple roll mill is preferably used.

Also, stabilization of dispersion liquid droplets may be further accelerated by addition of the following water-soluble polymer.

Examples of the water-soluble polymer include cellulose-based compounds (e.g., methyl cellulose, ethyl cellulose, hydroxyethyl cellulose, ethyl hydroxy cellulose, carboxy methyl cellulose, hydroxypropyl cellulose and saponification products thereof); gelatin, starch, dextrin, Arabic rubber, chitin, chitosan, polyvinyl alcohol, polyvinyl pyrrolidone, polyethylene glycol, polyethylene imine, polyacrylamide, acrylic acid (salt)-containing polymers (e.g., sodium hydroxide-partially neutralized products of sodium polyacrylate, potassium polyacrylate, ammonium polyacrylate and polyacrylic acid, and sodium acrylate-acrylic acid ester copolymer); sodium hydroxide-partially neutralized products of a styrene-maleic anhydride copolymer; and water-soluble polyurethanes (reaction products of polyethylene glycol, polycaprolactone diol etc. with polyisocyanate).

<Releasing Agent>

In addition, when the colored resin particle is used as a latent electrostatic image-developing toner, a releasing agent may be dispersed in an organic solvent for the purpose of improving fixing-releasability.

As the releasing agent, a material which exhibits a sufficiently low viscosity, such as wax or silicone oil, when heated in a fixing process and which is difficult to be soluble in or swollen on other materials than colored resin particles and the surface of a fixing member is used. In consideration of the storage stability of colored resin particle itself, it is preferable to use a wax which usually exists as a solid in colored resin particles when stored.

Examples of the wax include long-chain hydrocarbons and carbonyl group-containing waxes. Examples of the long-chain hydrocarbons include polyolefin waxes (e.g., polyethylene wax, and polypropylene wax); petroleum waxes (e.g., paraffin wax, Sazole wax, and microcrystalline wax); and Fischer-Tropsh wax.

Examples of the carbonyl group-containing wax include polyalkanate esters (e.g. carnauba wax, montan wax, trimethylolpropane tribehenate, pentaerythritol tetrabehenate, pentaerythritol diacetate dibehenate, glycerine tribehenate, and 1,18-octadecanediol distearate), polyalkanol esters (e.g. tristearyl trimellitate and distearyl maleate), polyalkanic acid amides (e.g. ethylenediamine dibehenyl amide), polyalkyl amides (e.g. tristearyl trimellitate amide), and dialkyl ketones (e.g. distearyl ketone).

Among these, long-chain hydrocarbons are particularly preferable for their excellence in releasability. Further, when long-chain hydrocarbon is used as a releasing agent, a carbonyl group-containing wax may be used in combination.

<Charge Controlling Agent>

Further, a charge controlling agent may be dissolved or dispersed in the organic solvent, as necessary.

As the charge controlling agent, any known charge controlling agents can be used. Examples thereof include nigrosine based dyes, triphenylmethane based dyes, chromium containing metal complex dyes, molybdic acid chelate pigments, rhodamine based dyes, alkoxy based amines, quaternary ammonium salts (including fluorine modified quaternary ammonium salts), alkyl amide, a simple substance of phosphorus or compounds thereof, a simple substance of tungsten or compounds thereof, fluorine based active agents, metal salts of salicylic acid and metal salts of salicylate derivatives. Specifically, the examples of the charge controlling agent include BONTRON 03 of the nigrosine based dye, BONTRON P-51 of the quaternary ammonium salt, BONTRON S-34 of the metal-containing azo dye, E-82 of oxynaphthoic acid-based metal complex, E-84 of salicylic acid-based metal complex, E-89 of phenol-based condensate (manufactured by Orient Chemical Industries Ltd.); TP-302 and TP-415 of a quaternary ammonium salt molybdenum complex (manufactured by Hodogaya Chemical Co., Ltd.); Copy Charge PSY VP2038 of the quaternary ammonium salt, Copy Blue PR of the triphenylmethane derivative, Copy Charge NEG VP2036 and Copy Charge NX VP434 of the quaternary ammonium salt (manufactured by Hoechst); LRA-901, and LR-147 which is a boron complex (manufactured by Japan Carlit Co., Ltd.); copper phthalocyanine, perylene, quinacridone, azo-based pigments, and polymer compounds having functional groups such as sulfonic acid group, carboxyl group, and quaternary ammonium salt.

<Production Method>

The following describes a production method of the colored resin particle.

(Oil Phase Production Step)

As a method of producing an oil phase in which a resin, a colorant and the like are dissolved or dispersed in an organic solvent, the resin, colorant and the like may be gradually added into an organic solvent while the organic solvent being stirred, so that the resin, colorant and the like are dissolved or dispersed therein. When a pigment is used as a colorant, and/or when agents among releasing agents and charge controlling agents which are difficult to be dissolved in an organic solvent are added, it is preferable to make particles small in size prior to addition to the organic solvent.

As described above, preparation of a masterbatch of colorant is one method, and a similar procedure can be employed for such releasing agents and charge controlling agents.

As another method, a dispersion auxiliary is added as necessary, and a colorant, releasing agent, charge controlling agent are dispersed in wet process in an organic solvent, thereby obtaining a wet master.

As still another method, when materials which can be dissolved at a temperature lower than the boiling point of an organic solvent is to be dispersed, a dispersion auxiliary is added as required in the organic solvent, heated while being stirred together with the dispersoid to be dissolved once, followed by cooling while being stirred or applying a shearing force to be crystallized, thereby generating microcrystals of the dispersoid.

The colorant, releasing agent and charge controlling agent dispersed in an organic solvent using the above method may be further subjected to dispersion treatment after being dissolved or dispersed with the resin. In dispersion treatment, a known dispersing machine such as a bead mill and disc mill can be used.

(Core Particle Production Step)

A method of producing a dispersion liquid in which core particles containing an oil phase are dispersed, the dispersing liquid being produced by dispersing the oil phase obtained in the step described above is dispersed in an aqueous medium containing at least a surfactant, is not particularly limited, but known equipment such as low-speed shearing method, high-speed shearing method, frictional method, high-pressure jet method and a method of using ultrasonic method may be applied. Among them, the high-speed searing method is preferable for making the particle diameter of the dispersion 2 μm to 20 μm. The rotational frequency of a high speed shearing dispersion machine is not particularly limited, but it is typically 1,000 rpm to 30,000 rpm and preferably 5,000 rpm to 10,000 rpm. The dispersion time period is not particularly limited, but it is typically 1 minute to 5 minutes in the case of a batch mode. When the dispersion time is more than 5 minutes, small-diameter particles in undesired size may remain, and the system may be excessively dispersed to become unstable, causing aggregated particles and coarse particles. In contrast, when the dispersion time is shorter than 1 minute, the uniformity of particles degrades and thus it becomes difficult to obtain a desired particle size distribution. The temperature during dispersion is typically 0° C. to 40° C., and preferably 10° C. to 30° C. When the temperature during dispersion is higher than 40° C., unfavorably, movement of molecules is activated and the dispersion stability degrades, easily causing aggregated particles and coarse particles. When the temperature during dispersion is less than 0° C., the viscosity of the dispersion becomes higher, and thus the production efficiency degrades due to an increased shearing force energy necessary for dispersion.

As for the surfactant, the same method as the production method of a resin fine particle described above can be employed. However, to efficiently disperse oil droplets containing a solvent, disulfonate which is high in HLB is preferable. The concentration of the surfactant in the aqueous medium is from 1% by mass to 10% by mass, preferably from 2% by mass to 8% by mass, and more preferably from 3% by mass to 7% by mass. When the concentration of the surfactant is more than 10% by mass, unfavorably, oil droplets become excessively small, a micelle structure is formed and undesirably the dispersion stability degrades, causing an increase in size of oil droplets. When the concentration of the surfactant is less than 1% by mass, unfavorably, oil droplets cannot be stably dispersed, causing an increase in size of oil droplets.

<Resin Fine Particle-Attaching Step>

In the obtained core particle dispersion liquid, liquid droplets of core particles can be stably present during a stirring treatment. In this state, the resin fine particle dispersion liquid is introduced into the core particle dispersion liquid to thereby cause resin fine particles to adhere to surfaces of core particles. The introduction of the resin fine particle dispersion liquid is preferably performed over 30 seconds. When the introducing time is less than 30 seconds, unfavorably, the dispersion system rapidly changes in quality, causing occurrence of aggregated particles and nonuniform attachment of resin fine particles on surfaces of core particles. In contrast, when the resin fine particle dispersion liquid is added for a long period of time, for example, over 60 minutes, it is unfavorable in terms of production efficiency.

The resin fine particle dispersion liquid may be diluted or condensed before being introduced to the core particle dispersion liquid, for the purpose of appropriately adjusting the concentration. The concentration of the resin fine particle dispersion liquid is preferably from 5% by mass to 30% by mass, and more preferably from 8% by mass to 20% by mass. When the concentration of the resin fine particle dispersion liquid is less than 5% by mass, a change in concentration of the organic solvent accompanied by the introduction of the dispersion liquid increases to cause insufficient attachment of resin fine particles. When concentration of the resin fine particle dispersion liquid is more than 30% by mass, this is preferably avoided because resin fine particles are likely to be eccentrically present in the core particle dispersion liquid, resulting nonuniform attachment of resin fine particles.

The reason why resin fine particles are attached to core particles with sufficiently high strength by the method of the present invention is considered as follows. Core particles are freely deformable when resin fine particles are attached to liquid droplets of core particles, and thus a contact surface between each liquid droplet with an interface of resin fine particles is sufficiently formed, and resin fine particles are swollen or dissolved by the effect of an organic solvent, thereby resin fine particles are easily bonded to the resin in core particles. Therefore, in this state, the organic solvent is necessary to be stably present in the system. More specifically, the amount of the organic solvent (present in the core particle dispersion liquid) is preferably from 50% by mass to 150% by mass, and more preferably from 70% by mass to 125% by mass to the solid content of (the resin, colorant, and a releasing agent and a charge controlling agent as required). When the amount of the organic solvent is more than 150% by mass, it is unfavorable because the amount of colored resin particles obtainable in one production process is reduced, causing low production efficiency, and the dispersion stability degrades and thus it becomes difficult to stably produce colored resin particles.

The temperature at which resin fine particles are attached to core particles is 10° C. to 60° C., and more preferably 20° C. to 45° C. When the temperature is higher than 60° C., the energy necessary for production is increased and thus an increase in production environmental impact is caused. In addition, resin fine particles having a low acid value may be present on surfaces of liquid droplets, possibly causing unstable dispersion and occurrence of coarse particles. In contrast, when the temperature is lower than 10° C., unfavorably, the viscosity of the dispersion increases, causing insufficient attachment of resin fine particles.

(Desolvation Step)

To remove the organic solvent from the resulting colored resin dispersion, a method can be employed in which the temperature of the system is increased while the entire system being stirred, and the organic solvent in liquid droplets is completely evaporated and removed from the system.

In addition, the resulting colored resin dispersion is sprayed in a dry atmosphere while being stirred, thereby the organic solvent in liquid droplets can be completely removed. Besides the above methods, the colored resin dispersion may be depressurized while being stirred to thereby evaporate and remove the organic solvent. The latter two methods may be combined with the first method.

As the dry atmosphere in which the emulsified dispersion is sprayed, gases such as a gas obtained by heating air, nitrogen, carbon gas, combustion gas, and in particular, various air streams heated to a temperature higher than the boiling point of the highest boiling point of a solvent used are generally used. Sufficiently colored resin particles with high quality can be obtained with a short period of time using a spray drier, belt drier, rotary kiln.

(Aging Step)

When a modified resin having an isocyanate group in its terminal is added to the dispersion liquid, an aging step may be employed to accelerate a chain-extending/crosslinking reaction of the isocyanate. The aging time is typically from 10 minutes to 40 hours, and preferably from 2 hours to 24 hours. The reaction temperature is typically 0° C. to 65° C., and more preferably 35° C. to 50° C.

(Washing, Drying Step)

As the step of washing and drying toner particles that have been dispersed in an aqueous medium, a known technique is used. That is, solid and liquid are separated from each other using a centrifugal separator, a filter press, etc., and thereafter the resulting toner cake is re-dispersed in ion-exchanged water from normal temperature to about 40° C. Further, the solid-liquid separation step is repeated several times to remove impurities and surfactant therefrom. Afterwards, in the present invention, it is important to adjust a pH of the filter cake with an acid because an inorganic base is dispersed in preparation of the oil phase and the alkali components thereof are neutralized. After these processes, the filter cake is dried by an air-stream drier, circular-air drier, depressurization drier, vibration-flowing deriver or the like to thereby obtain a toner powder. At this time, toner fine particle components may be removed therefrom by centrifugal separation. Also, after drying, it is possible to obtain a desired particle size distribution using a known classifier.

In addition, when dried colored resin particles are in a soft aggregated state and inconvenient in practical use, the particle may be broken using a device such as a jet mill, HENSCHEL MIXER, super mixer, coffee mill, Auster blender, food processor, to be resolve the soft aggregation.

(External Addition)

It is possible to prevent desorption of different type particles from surfaces of the composite particles thus obtained, by fixing and melting on surfaces of the composite particles the resulting toner powder after drying and the different type particles such as fine releasing agent particles, fine charge controlling agent particles, fine fluidizer particles, and fine colorant particles by mixing the toner powder with the different type particles or applying a mechanical impact force to the powder mixture of the toner powder with the different type particles. The specific method for applying the mechanical impact force includes method of applying the impact force to the mixture using blades which rotate at high speed, and method of placing the mixture in high speed gas flow and crashing the particles one another or the complexed particles to an appropriate crash plate by accelerating. An apparatus used for such a method includes NOBILTA (manufactured by Hosokawa Micron Ltd.), METEO RAINBOW (manufactured by Nippon Pneumatic MFG. Co., Ltd.), HYBRIDIZATION SYSTEM (Nara Machinery Co., Ltd.). The colored resin particle of the present invention can be used as a latent electrostatic image-developing toner.

The following describes an image forming method, an image forming apparatus and a toner cartridge in which the colored resin particle of the present invention is used as a latent electrostatic image-developing toner.

An image forming apparatus according to the present invention includes at least a latent image bearing member which carries a latent image, a charging unit configured to uniformly charge a surface of the image bearing member, an exposing unit configured to expose the charged surface of the latent image bearing member based on image data and to white a latent electrostatic image on the surface of the latent image bearing member, a developing unit configured to supply a toner to the latent electrostatic image formed on the surface of the latent image bearing member so as to form a visible image, a transfer unit configured to transfer the visible image on the surface of the latent image bearing member onto the surface of the latent image bearing member and a fixing unit configured to fix the visible image on a transfer medium, and further include other units suitably selected as required, for example, a charge eliminating unit, a cleaning unit, a recycling unit, a controlling unit, and the like.

An image forming method according to the present invention includes uniformly charging a surface of a latent image bearing member, exposing the charged surface of the latent image bearing member based on image data so as to write a latent electrostatic image thereon, forming a developer layer formed of a developer having a predetermined layer thickness on a developer bearing member by a developer layer-regulating member so as to develop the latent electrostatic image that has been formed on the surface of the latent image bearing member via the developer layer, and to form a visible image, transferring the visible image on the latent image bearing member onto an image transfer medium, and fixing the visible image on the image transfer medium, and includes at least a latent electrostatic image forming step, the developing step, the image transfer step, and the fixing step, and further includes other steps suitably selected as necessary, for example, a charge removing step, a cleaning step, a recycling step, a controlling step.

The latent electrostatic image can be formed by, for example, uniformly charging a surface of the latent image bearing member through the charging unit and then exposing imagewise through the exposing unit. The formation of a visible image through the developing can be performed by developing a latent electrostatic image on a photoconductor drum serving as the image bearing member. More specifically, the latent electrostatic image can be developed by forming a toner layer on a developing roller serving as a developer bearing member and conveying the toner layer on the developing roller so as to be contact with the photoconductor drum. A toner is agitated by an agitating unit and mechanically supplied to a developer supplying member. A toner which is supplied from the developer supplying member and accumulates on the developer bearing member passes through a developer-layer regulating member provided so as to be contact with a surface of the developer bearing member, thereby a uniform thin layer is formed and the toner is further charged. The latent electrostatic image formed on the latent image bearing member is supplied with a charged toner by the developing unit in a developing area, thereby the latent electrostatic image is developed to become a toner image.

The visible image can be transferred by, for example, charging the latent image bearing member (photoconductor) using a transfer charger so as to electrically charge the visible image. The transfer of the visible image can be performed using a transfer unit. The fixing of the transferred visible image is performed by fixing the visible image, which has been transferred onto a recording medium, using a fixing unit. The fixing may be performed for each of the toner images having different colors when they are transferred to the recording medium, or may be performed at a time for superimposed toner images. The fixing device is not particularly limited and can be appropriately selected depending on the intended purpose, with a preferred example being a conventional heating and pressurizing unit. The heating and pressurizing unit is, for example, a combination of a heating roller and a pressurizing roller, a combination of a heating roller, a pressurizing roller and an endless belt. In general, the heating temperature of the heating and pressurizing unit is preferably 80° C. to 200° C.

Here, a description is given for a basic constitution of the image forming apparatus (printer) of the present embodiment with reference to the drawings. FIG. 1 is a schematic diagram showing a constitution of the image forming apparatus according to an embodiment of the present invention. In this instance, a description is given for one embodiment, which is used in an electrophotographic image forming apparatus. The image forming apparatus is to form color images by using four different colors of toner, that is, yellow (hereinafter, abbreviated as "Y"), cyan (hereinafter, abbreviated as "C"), magenta (hereinafter, abbreviated as "M") and black (hereinafter, abbreviated as "K").

First, a description is given for a basic constitution of the image forming apparatus ("tandem-type image forming apparatus") having a plurality of latent image bearing members in which a plurality of these latent image bearing members are arranged in a line in the moving direction of a surface moving member. The image forming apparatus is provided with four photoconductors, 1Y, 1C, 1M and 1K as latent image bearing members. In addition, this example mentions a drum-shaped photoconductor but a belt-shaped photoconductor may be also adopted. Each of the photoconductors, 1Y, 1C, 1M and 1K, is rotated and driven in a direction given in the arrow of the drawing while in contact with an intermediate transfer belt 10, which is the surface moving member. Each of the photoconductors, 1Y, 1C, 1M and 1K, is rotated and driven in a direction given in the arrow of the drawing while in contact with the intermediate transfer belt 10. Each of the photoconductors 1Y, 1C, 1M, and 1K may be composed of a photosensitive layer formed on a relatively thin cylindrical conductive base and a protective layer formed on the photosensitive layer. Further, an intermediate layer may be formed between the photosensitive layer and the protective layer.

Figure 2:
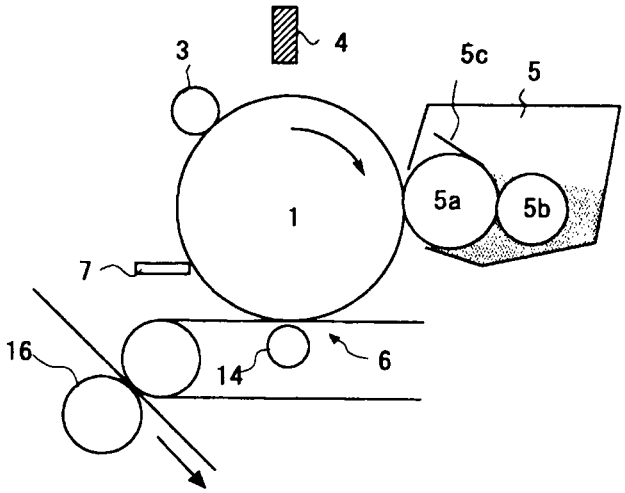
FIG. 2 is a schematic cross-sectional diagram illustrating a structure of an image forming unit in which a photoconductor is provided.

FIG. 2 is a schematic diagram showing a constitution of an image forming portion 2 at which photoconductors are disposed. In addition, since all the photoconductors, 1Y, 1C, 1M and 1K, at each of the image forming portions, 2Y, 2C, 2M and 2K, are constituted in a similar manner, only one of the image forming portions 2 is illustrated and symbols for color identification, Y, C, M, K, are omitted for illustration. A charging device 3 as a charging unit, a developing device 5 as a developing unit, a transfer device 6 for transferring a toner image on the photoconductor 1 to a recording medium or an intermediate transfer member 10 and a cleaning device 7 for removing untransferred toner remaining on the photoconductor 1 are arranged in the thus described order along the surface moving direction thereof around the photoconductor 1. A space is secured between the charging device 3 and the developing device 5 in such a manner that light emitted from an exposure device 4 as a latent image forming unit can pass through to the photoconductor 1.

The charging device 3 charges negatively a surface of the photoconductor 1. The charging device 3 of the present embodiment is provided with a charging roller as a charge member, which conducts charging treatment by the so-called contact-charging method. In other words, the charging device 3 allows the charging roller to be in contact with or adjacent to the surface of the photoconductor 1, thereby applying negative bias to the charging roller to charge the surface of the photoconductor 1. Direct-current charge bias is applied to the charging roller so that the surface potential of the photoconductor 1 is set to be −500V.

In addition, alternating-current bias is superimposed on direct-current bias and the thus obtained bias is used as charge bias. Further, the charging device 3 may be provided with a cleaning brush for cleaning the surface of the charging roller. Still further, a thin film may be wound around the both ends of the charging roller as the charging device 3 and placed so as to be in contact with the surface of the photoconductor 1. With this configuration, the surface of the charging roller is in close proximity to the surface of the photoconductor 1, with only the thickness of the film being spaced away. Therefore, the charge bias applied to the charging roller causes electric discharge between the surface of the charging roller and the surface of the photoconductor 1, and the surface of the photoconductor 1 is charged by the discharge.

A latent electrostatic image corresponding to each color after exposure by an exposure device 4 is formed on the surface of the thus charged photoconductor 1. The exposure device 4 writes the latent electrostatic image corresponding to each color with respect to the photoconductor 1 on the basis of image information corresponding to each color. In addition, the exposure device 4 of the present embodiment is based on a laser process but other processes made up of an LED array and an image forming unit can also be adopted.

Toner filled into the developing device 5 from toner bottles 31Y, 31C, 31M and 31K, is conveyed by a supply roller 5*b* and carried on a developing roller 5*a*. The developing roller 5*a* is conveyed to a developing area, which is opposed to the photoconductor 1. Here, the developing roller 5*a* is surface-moved to the same direction at a linear velocity faster than the surface of the photoconductor 1 at an area opposed to the photoconductor 1 (hereinafter, referred to as "developing area"). Then, toner is supplied to the surface of the photoconductor 1, while toner on the developing roller 5*a* slidingly rubs the surface of the photoconductor 1. At this time, −300V developing bias is applied to the developing roller 5*a* from a power supply (not illustrated), by which a developing electrical field is formed at the developing area. Then, an electrostatic force moving toward the latent electrostatic image is to act on the toner on the developing roller 5*a* between a latent electrostatic image on the photoconductor 1 and the developing roller 5*a*. Thereby, the toner on the developing roller 5*a* is made adhere to the latent electrostatic image on the photoconductor 1. Upon adhesion, the latent electrostatic image on the photoconductor 1 is developed into a toner image corresponding to each color.

The intermediate transfer belt 10 of the transfer device 6 is stretched between three support rollers 11, 12, and 13 and constituted so as to move endlessly toward a direction given in the arrow of the drawing. A toner image on each of the photoconductors, 1Y, 1C, 1M and 1K is transferred onto the intermediate transfer belt 10 by an electrostatic transfer process so as to overlap each other. The electrostatic transfer process is also available as a constitution in which a transfer charger is used. In this instance, such a constitution is adopted that a transfer roller 14 producing a smaller quantity of transfer dust is used. More specifically, primary transfer rollers, 14Y, 14C, 14M and 14K are arranged as the respective transfer devices 6 at the back face of a part of the intermediate transfer belt 10 in contact with each of the photoconductors, 1Y, 1C, 1M and 1K. In this instance, a primary transfer nip portion is formed by a part of the intermediate transfer belt 10 pressed by each of the primary transfer rollers, 14Y, 14C, 14M and 14K and each of the photoconductors, 1Y, 1C, 1M and 1K. Then, in transferring a toner image on each of the photoconductors, 1Y, 1C, 1M, 1K to the intermediate transfer belt 10, positive bias is applied to each of the primary transfer rollers 14. Thereby, a transfer electrical field is formed at each of the primary transfer nip portions, and the toner image on each of the photoconductors 1Y, 1C, 1M and 1K electrostatically adheres on the intermediate transfer belt 10 and is transferred.

A belt cleaning device 15 for removing toner remaining on the surface thereof is installed around the intermediate transfer belt 10. The belt cleaning device 15 is constituted so as to recover unnecessary toner adhered on the surface of the intermediate transfer belt 10 by using a fur brush and a cleaning blade. In addition, the thus recovered unnecessary toner is conveyed by a conveying unit (not illustrated) from the belt cleaning device 15 to a discharged toner tank (not illustrated).

A secondary transfer roller 16 is arranged in contact with a part of the intermediate transfer belt 10 stretched between support rollers 13. A secondary transfer nip portion is formed at a space between the intermediate transfer belt 10 and the secondary transfer roller 16, and a transfer sheet as a recording member is to be sent into the space at a predetermined timing. The transfer sheet is accommodated inside a feed cassette 20 below in a drawing illustrating the exposure device 4 and conveyed up to the secondary transfer nip portion by a supply roller 21, a pair of registration rollers 22 and the like. Then, toner images overlapped on the intermediate transfer belt 10 are all together transferred on the transfer sheet at the secondary transfer nip portion. At the secondary transfer, positive bias is applied to the secondary transfer roller 16, by which a transfer electrical field is formed to transfer the toner images on the intermediate transfer belt 10 to the transfer sheet.

A heat fixing device 23 is arranged as a fixing unit at the secondary transfer nip portion downstream from the conveying direction of transfer sheets. The heat fixing device 23 is provided with a heating roller 23*a* having a built-in heater and a pressing roller 23*b* for applying pressure. A transfer sheet, which has passed through the secondary transfer nip portion, is caught between these rollers and given heat and pressure. Thereby, toner on the transfer sheet is melted and a toner image is fixed on the transfer sheet. The transfer sheet after being fixed is discharged by a discharging roller 24 on a discharge tray on the upper face of an apparatus.

The developing device 5 is provided with a developing roller 5*a* as a developer support, which is partially exposed from an opening of the casing thereof. Further, in this instance, used is a carrier-free one component developer. The developing device 5 accommodates therein toner corresponding to colors supplied from toner bottles 31Y, 31C, 31M and 31K, shown in FIG. 1. These toner bottles 31Y, 31C, 31M and 31K, are attached to or detached from the main body of the image forming apparatus so that they can be exchanged respectively as a single unit. As a result, when toner is used up, only the toner bottle concerned, 31Y, 31C, 31M or 31K, may be exchanged. Therefore, other bottles, which are still usable when the toner concerned is used up, can be used as they are, thus reducing the cost for the user.

Figure 3:
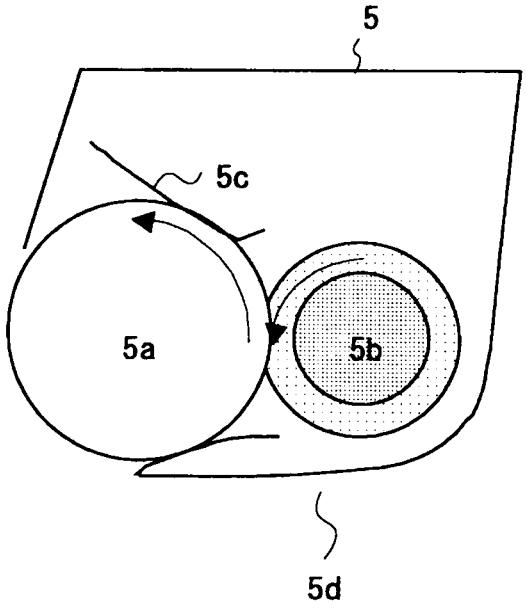
FIG. 3 is a schematic cross-sectional diagram illustrating a structure of a developing device.

FIG. 3 is a schematic diagram illustrating a constitution of a developing device.

The developer (toner) at the toner filling portion is conveyed to the nip portion of the developing roller 5*a*, while being stirred by the supply roller 5*b* as a developer supplying member which carries on its surface the developer to be supplied to the photoconductor 1. At this time, the supply roller 5*b* and the developing roller 5*a* rotate in a reverse (counter) direction to each other. Further, the amount of toner on the developing roller 5*a* is regulated by a regulating blade 5*c* serving as a developer layer-regulating member disposed in contact with the developing roller 5*a*, thereby forming a toner thin layer on the developing roller 5*a*. The toner is also slidingly rubbed between the supply roller 5*b* and the nip portion of the developing roller 5*a* and between the regulating blade 5*c* and the developing roller 5*a* and controlled so as to be appropriately charged.

Figure 4:
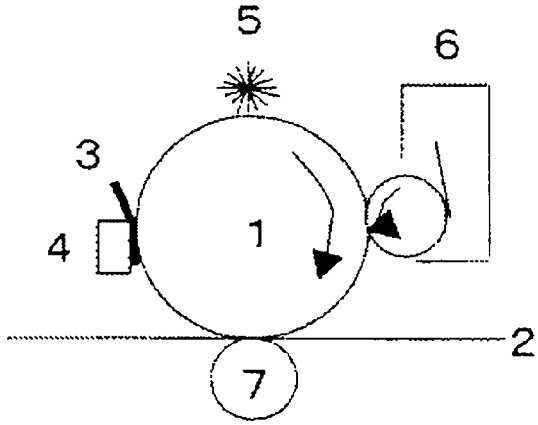
FIG. 4 is a schematic cross-sectional diagram illustrating a structure of a process cartridge.

The developer can be used in an image forming apparatus provided with a process cartridge as illustrated, for example, in FIG. 4. In the present invention, a plurality of components selected from a latent electrostatic image bearing member, a latent electrostatic image-charging unit, a developing unit, and the like are integrally combined into one unit as a process cartridge. This process cartridge is detachably mounted on a main body of an image forming apparatus such as a copier and a printer.

The process cartridge illustrated in FIG. 4 is equipped with a latent electrostatic image bearing member 1, a latent electrostatic image-charging unit 5, a charge applying unit 3 (having a sheet press-contacting member 4 for electrically charging, again, toner remaining on a surface of the latent electrostatic image bearing member 1 after an image is transferred to the subsequent step), and a developing unit 6. In FIG. 4, reference numeral 7 is a transfer unit for use in transferring a toner image onto a transfer member 2.

The following describes the operation of the process cartridge. The latent electrostatic image bearing member 1 is driven to rotate at a predetermined circumferential speed.

The electrostatic image bearing member 1 receives on its circumferential surface uniform charge of predetermined bias, i.e., positive bias or negative bias, form a charging unit 5, and then receives image exposure light from a not illustrated image exposing unit (e.g., slight exposure, laser beam scanning exposure), thereby latent electrostatic images are sequentially formed on the circumferential surface of the latent electrostatic image bearing member 1. The formed latent electrostatic images are then developed with a toner by the developing unit 6. The developed toner images are sequentially transferred from a paper feed portion to a space between the electrostatic image baring member 1 and the transfer unit 7 and then transferred onto a transfer material 2 which is fed in synchronization with the rotation of the electrostatic image bearing member 1.

The transfer material 2 subjected to image transfer is separated from the surface of the latent electrostatic image bearing member, introduced into a not illustrated image fixing unit to be image-fixed to be output as a copy or print outside the image forming apparatus. On the surface of the latent electrostatic image bearing member 1 after image transfer, untransferred toner is electrically charged again by the charge applying unit 3 for electrically charging again toner remaining on the surface of the latent electrostatic image baring member 1 after image transfer. The charged tone passes through the charged portion of the latent electrostatic image bearing member, and collected in a developing step to be repeatedly used for subsequent image forming processes.

EXAMPLES

Hereinafter, the present invention will be further described in detail with reference to Examples, however, the following Examples shall not be construed as limiting the scope of the present invention. It should be noted that in the following examples, the unit "part(s) means "part(s) by mass" and the unit "%" of a concentration means "% by mass" unless otherwise specified.

The following describes the measuring methods of physical properties of starting materials used in the Examples.

<Measurement of Particle Diameter of Colored Resin Particle>

The volume average particle diameter of colored resin particles was measured by the Coulter Counter method. Examples of measuring methods of the volume average particle diameter include COULTER COUNTER TA-II, COULTER MULTISIZER II, and COULTER MULTISIZER III (all manufactured by Coulter Electronics, Inc.). The following describes the measuring method of the volume average particle diameter of cored resin particles.

First, 0.1 mL to 5 mL of a surfactant (alkylbenzene sulfonic acid salt) was added as a dispersant in 100 mL to 150 mL of an electrolyte. Here, as the electrolyte solution, an aqueous solution containing NaCl of about 1% (primary sodium chloride, ISOTON-II (from Coulter Electronics Inc.)) was used. Next, 2 mg to 20 mg of a measurement sample was added to the electrolyte solution. The electrolyte solution, in which the sample was suspended, was dispersed using an ultrasonic dispersing machine for about 1 minute to about 3 minutes to prepare a toner suspension liquid. The volume and the number of toner particles or toner were measured by the above instrument using an aperture of 100 μm to determine a volume average particle size distribution and a number average particle size distribution of the toner.

In the measurement, the following 13 channels were used to measure particles having diameters of 2.00 μm or greater and smaller than 40.30 μm: a channel having a diameter of 2.00 μm or greater and smaller than 2.52 μm, a channel having a diameter of 2.52 μm or greater and smaller than 3.17 μm; a channel having a diameter of 3.17 μm or greater and smaller than 4.00 μm; a channel having a diameter of 4.00 μm or greater and smaller than 5.04 μm; a channel having a diameter of 5.04 μm or greater and smaller than 6.35 μm; a channel having a diameter of 6.35 μm or greater and smaller than 8.00 μm; a channel having a diameter of 8.00 μm or greater and smaller than 10.08 μm; a channel having a diameter of 10.08 μm or greater and smaller than 12.70 μm; a channel having a diameter of 12.70 μm or greater and smaller than 16.00 μm; a channel having a diameter of 16.00 μm or greater and smaller than 20.20 μm; a channel having a diameter of 20.20 μm or greater and smaller than 25.40 μm; a channel having a diameter of 25.40 μm or greater and smaller than 32.00 μm; and a channel having a diameter of 32.00 μm or greater and smaller than 40.30 μm.

<Measurement of Particle Diameter of Resin Fine Particle to be Attached to Surface of Core Particle>

The diameters of resin fine particles were measured using UPA-150EX (manufactured by NIKKISO Co., Ltd.).

<Measurement of Molecular Weight (GPC)>

The molecular weight of resin was measured by GPC (Gel Permeation Chromatography) under the following conditions:

- Device: GPC-150C (manufactured by Waters Instruments, Inc.)
- Column: KF801 to KF807 (manufactured by Showdex Co.)
- Temperature: 40° C.
- Solvent: THF (tetrahydrofuran)
- Rate of flow: 1.0 mL/min
- Sample: 0.1 mL of a sample having a concentration of 0.05% to 0.6% was injected into the column.

Based on a molecular weight distribution of the resin measured under the above conditions, a number average molecular weight and a weight average molecular weight of the resin were calculated from a molecular weight calibration curve created using monodispersed polystyrene provided as standard samples. As the standard polystyrene samples, Nos. S-7300, S-210, S-390, S-875, S-1980, S-10.9, S-629, S-3.0, S-0.580 of SHOWDEX STANDARD, and toluene (available from Showa Denko K.K.) were used. As the detector, an RI (refractive index) detector was used.

<Measurement (DSC) of Glass Transition Temperature (Tg)>

As a device for measuring the Tg of samples, a TG-DSC system, TAS-100 (manufactured by Rigaku Corporation) was used.

First, about 10 mg of a resin sample was placed in an aluminum-sample container, the container was mounted on a holder unit of the TG-DSC system and then set in an electric oven. The sample was heated from room temperature to 150° C. at a temperature increase rate of 10° C./min, left standing at 150° C. for 10 minutes, and then cooled to room temperature and left standing for 10 minutes. The sample was heated again under a nitrogen atmosphere to 150° C. at a temperature increase rate of 10° C./min to thereby perform the DSC measurement. Using the analysis system in the TAS-100 system, the Tg was calculated from a tangent point between an endothermic curve obtained near Tg and the base line.

<Measurement of Acid Value>

The acid value of the resin was measured according to JIS K1557-1970. The following describes details of the measuring method.

About 2 g of a pulverized product of each sample was accurately weighed (W(g)).

The sample was placed in a 200 mL-Erlenmeyer flask, 100 mL of a mixture solution of toluene/methanol (2:1) was added thereinto and dissolved for 5 hours, and then a phenol phthalein solution was added as an indicator into the solution.

The solution was titrated with a 0.1N potassium hydroxide alcohol solution using a burette. The amount of the KOH solution at this time was defined as S (mL). The KOH solution was subjected to a blank test, and the amount of the KOH solution at this time was defined as B (mL).

The acid value of the resin sample was calculated by the following equation:

$$\text{Acid Value}=[(S-B)\times f\times 5.61]/W$$

(f: factor of KOH solution)

<Measurement of Hydroxyl Value>

The hydroxyl value of resin was measured according to JIS K0070-1966 through the following method.

A resin sample was weighed in a 100 mL recovery flask and 5 mL (accurately weighed) of an acetylated reagent was added thereto.

Subsequently, the recovery flask was heated by dipping in a bath heated at 100° C.±5° C.

One hour to two hours later, the flask was taken out from the bath, left standing to cool, and then ion exchanged water was added thereto. Then, the flask was shaken to decompose aqueous acetic acid.

Further, to completely decompose aqueous acetic acid, the flask was heated again in the bath for 10 minutes or longer and then left standing to cool. Thereafter, the wall of the flask was washed thoroughly with an organic solvent.

This solution was subjected to a potentiometric titration with a N/2 potassium hydroxide alcohol solution using glass electrodes to thereby determine a hydroxyl value of the resin (according to (JIS K0070-1966).

<Measurement of Solid Content Concentration>

The solid content concentration of an oil phase was measured in the following procedure.

On an aluminum pan (about 1 g to about 3 g, the mass had been accurately weighed in advance), about 2 g of the oil phase was placed within 30 seconds after weighing, and the mass of the oil phase placed on the aluminum pan was accurately weighed. This aluminum pan was put in an oven heated at 150° C. for 1 hour to evaporate the solvent. Thereafter, the aluminum pan was taken out from the oven and left standing to cool, followed by measuring the mass of the total mass (the total mass of the aluminum pan and the solid content of the oil phase) with an electronic balance. The mass of the aluminum pan was subtracted from the total mass of the aluminum pan and the solid content of the oil phase to calculate a mass of the solid content of the oil phase. The mass of the solid content of the oil phase was divided by the mass of the oil phase to calculate a solid content concentration of the oil phase. A ratio of the amount of the solvent to the solid content of the oil phase is a value obtained by dividing the mass of the solvent (i.e. a value obtained by subtracting the mass of the solid content of the oil phase from the mass of the oil phase) by the mass of the solid content of the oil phase.

[Production of Resin Fine Particle Dispersion Liquid 1]

Into a reaction vessel equipped with a condenser, a stirrer and a nitrogen inlet tube, sodium dodecyl sulfate (0.7 parts), and ion exchanged water (498 parts) were poured, dissolved by heating to 80° C. while being stirred, then a solution (in which potassium persulfate (2.6 parts) was dissolved in ion exchanged water (104 parts)) was added to the mixture, and 15 minutes later, a monomer mixture liquid (in which styrene monomer (200 parts), and n-octanethiol (4.2 parts) were mixed) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Resin Fine Particle Dispersion Liquid 1 having a volume average particle diameter of 105 nm.

[Production of Resin Fine Particle Dispersion Liquid 2]

Into a reaction vessel equipped with a condenser, a stirrer and a nitrogen inlet tube, sodium dodecyl sulfate (0.7 parts), and ion exchanged water (498 parts) were poured, dissolved by heating to 80° C. while being stirred, then a solution (in which potassium persulfate (2.6 parts) was dissolved in ion exchanged water (105 parts)) was added to the mixture, and 15 minutes later, a monomer mixture liquid (styrene monomer (170 parts), butyl acrylate (12 parts), methacrylic acid (18 parts) and n-octanethiol (4.2 parts)) was added dropwise over 90 minutes. Subsequently, the temperature of the reaction system was maintained at 80° C. for 60 minutes to be subjected to polymerization reaction. Thereafter, the reaction system was cooled, thereby obtaining white-color Resin Fine Particle Dispersion Liquid 2 having a volume average particle diameter of 120 nm.

[Production of Resin Fine Particle Dispersion Liquid 3]

Into a reaction vessel equipped with a condenser, a stirrer and a nitrogen inlet tube, sodium dodecyl sulfate (0.7 parts), and ion exchanged water (498 parts) were poured, dissolved by heating to 80° C. while being stirred, then a solution (in which potassium persulfate (2.6 parts) was dissolved in ion exchanged water (104 parts)) was added to the mixture, and 15 minutes later, a monomer mixture liquid (styrene monomer (140 parts), and methoxydiethylene glycol methacrylate (60 parts)) was added dropwise over 90 minutes. Subsequently, the temperature of the reaction system was maintained at 80° C. for 60 minutes to be subjected to polymerization reaction. Thereafter, the reaction system was cooled, thereby obtaining white-color Resin Fine Particle Dispersion Liquid 3 having a volume average particle diameter of 115 nm.

[Production of Resin Fine Particle Dispersion Liquid 4]

In a 5-litter stainless steel oven, the after-mentioned [Linear Polyester 1] (1,500 g), an anionic surfactant "NEOPELEX G-15 (produced by KAO Corporation)" [sodium dodecylbenzene sulfonate (solid content: 15% by mass)] (100 g), a nonionic surfactant "EMULGEN 430 (produced by KAO Corporation)" [polyoxyethylene (26 mol), oleyl ether (HLB: 16.2)] (15 g), and a 5% by mass potassium hydroxide aqueous solution (689 g) were dispersed under stirring at 200 r/min with a paddle type stirring machine at 25° C.

The temperature of the reaction system was stabilized to 95° C. and maintained for 2 hours under stirring at 200 r/min with the paddle type stirring machine.

Subsequently, deionized water was added in a total amount of 2,845 g dropwise into the oven at a dropping rate of 15 g/min under stirring at 200 r/min with the paddle type stirring machine.

During dropping the deionized water, the temperature of the reaction system was maintained at 95° C.

Thereafter, the reaction system was cooled, thereby obtaining white-color Resin Fine Particle Dispersion Liquid 4 having a volume average particle diameter of 150 nm.

[Production of Resin Fine Particle Dispersion Liquid 5]

Into a reaction vessel equipped with a condenser, a stirrer and a nitrogen inlet tube, sodium dodecyl sulfate (0.6 parts), and ion exchanged water (466 parts) were poured, dissolved by heating to 80° C. while being stirred, then a solution (in which potassium persulfate (2 parts) was dissolved in ion exchanged water (81 parts)) was added to the mixture, and 15 minutes later, a monomer mixture liquid (styrene monomer (140 parts), butyl acrylate (20 parts), Polyester 1 (40 parts) and n-octanethiol (1.8 parts)) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Resin Fine Particle Dispersion Liquid 5 having a volume average particle diameter of 108 nm.

[Production of Resin Fine Particle Dispersion Liquid 6]

Into a reaction vessel equipped with a condenser, a stirrer and a nitrogen inlet tube, sodium dodecyl sulfate (1.4 parts), and ion exchanged water (498 parts) were poured, dissolved by heating to 80° C. while being stirred, then a solution (in which potassium persulfate (2.6 parts) was dissolved in ion exchanged water (104 parts)) was added to the mixture, and 15 minutes later, a monomer mixture liquid (styrene monomer (200 parts), and n-octanethiol (4.2 parts)) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Resin Fine Particle Dispersion Liquid 6 having a volume average particle diameter of 65 nm.

[Production of Resin Fine Particle Dispersion Liquid 7]

Into a reaction vessel equipped with a condenser, a stirrer and a nitrogen inlet tube, sodium dodecyl sulfate (1.0 part), and ion exchanged water (498 parts) were poured, dissolved by heating to 80° C. while being stirred, then a solution (in which potassium persulfate (2.6 parts) was dissolved in ion exchanged water (104 parts)) was added to the mixture, and 15 minutes later, a monomer mixture liquid (styrene monomer (200 parts), and n-octanethiol (4.2 parts)) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Resin Fine Particle Dispersion Liquid 7 having a volume average particle diameter of 95 nm.

[Synthesis of Linear Polyester 1]

Into a reaction vessel equipped with a condenser, a stirrer and a nitrogen inlet tube, an ethylene oxide (2 mol) adduct of bisphenol A (270 parts), a propylene oxide (2 mol) adduct of bisphenol A (497 parts), terephthalic acid (110 parts), isophthalic acid (102 parts), adipic acid (44 parts) and dibutyltin oxide (2 parts) were added, and reacted under normal pressure at 230° C. for 9 hours. Next, the reaction system was reacted under reduced pressure of 10 mmHg to 18 mmHg for 7 hours, and then trimellitic anhydride (40 parts) was added to the reaction vessel and further reacted at 180° C. under normal pressure for 2 hours to thereby synthesize [Linear Polyester 1]. [Linear Polyester 1] was found to have a number average molecular weight of 3,000, a weight average molecular weight of 8,600, a glass transition temperature of 49° C. and an acid value of 22 mgKOH/g.

[Synthesis of Linear Polyester 2]

Into a reaction vessel equipped with a condenser, a stirrer and a nitrogen inlet tube, an ethylene oxide (2 mol) adduct of bisphenol A (218 parts), a propylene oxide (2 mol) adduct of bisphenol A (460 parts), terephthalic acid (140 parts), isophthalic acid (145 parts), and dibutyltin oxide (2 parts) were added, and reacted under normal pressure at 230° C. for 8 hours. Next, the reaction system was reacted under reduced pressure of 10 mmHg to 18 mmHg for 6 hours, and then trimellitic anhydride (24 parts) was added to the reaction vessel and further reacted at 180° C. under normal pressure for 2 hours to thereby synthesize [Linear Polyester 2]. [Linear Polyester 2] was found to have a number average molecular weight of 7,600, a weight average molecular weight of 21,000, a glass transition temperature of 57° C. and an acid value of 15 mgKOH/g.

[Synthesis of Linear Polyester 3]

Into a reaction vessel equipped with a condenser, a stirrer and a nitrogen inlet tube, an ethylene oxide (2 mol) adduct of bisphenol A (229 parts), a propylene oxide (2 mol) adduct of bisphenol A (529 parts), terephthalic acid (208 parts), adipic acid (46 parts), and dibutyltin oxide (2 is parts) were added, and reacted under normal pressure at 230° C. for 8 hours. Next, the reaction system was reacted under reduced pressure of 10 mmHg to 15 mmHg for 5 hours, and then trimellitic anhydride (44 parts) was added to the reaction vessel and further reacted at 180° C. under normal pressure for 2 hours to thereby synthesize [Linear Polyester 3]. [Linear Polyester 3] was found to have a number average molecular weight of 2,500, a weight average molecular weight of 6,700, a glass transition temperature of 43° C. and an acid value of 25 mgKOH/g.

[Synthesis of Prepolymer]

Into a reaction vessel equipped with a condenser, a stirrer and a nitrogen inlet tube, an ethylene oxide (2 mol) adduct of bisphenol A (682 parts), a propylene oxide (2 mol) adduct of bisphenol A (81 parts), terephthalic acid (283 parts), trimellitic anhydride (22 parts), and dibutyltin oxide (2 parts) were added, reacted under normal pressure at 230° C. for 8 hours, and further reacted under reduced pressure of 10 mmHg to 15 mmHg for 5 hours to thereby obtain [Intermediate Polyester 1]. [Intermediate Polyester 1] was found to have a number average molecular weight of 2,100, a weight average molecular weight of 9,500, a glass transition temperature of 55° C., an acid value of 0.5 mgKOH/g and a hydroxyl value of 49 mgKOH/g.

Next, into another reaction vessel equipped with a condenser, a stirrer and a nitrogen inlet tube, [Intermediate Polyester 1] (411 parts), isophoronediisocyanate (89 parts) and ethyl acetate (500 parts) were added and reacted at 100° C. for 5 hours to thereby obtain isocyanate-modified polyester [Prepolymer 1]. [Prepolymer 1] was found to have a free isocyanate content of 1.53% by mass.

[Synthesis of Non-Linear Polyester Resin]

Into a reaction tank equipped with a condenser, a stirrer and a nitrogen inlet tube, a EO (2 mol) adduct of bisphenol A (350 parts), a PO (3 mol) adduct of bisphenol A (326 parts), terephthalic acid (278 parts), phthalic anhydride (40 parts), and potassium titanyl oxalate (1.5 parts) serving as a polycondensation catalyst were added, and reacted under a nitrogen air stream and a temperature of 230° C. for 10 hours while distilling away generated water. Next, the reaction system was reacted under reduced pressure of 5 mmHg to 20 mmHg, at the point in time when the acid value became 2 or less, the reaction system was cooled to 180° C., and then trimellitic anhydride (62 parts) was added to the reaction tank and reacted under normal pressure and a sealed state for 2 hours. After the reaction, the reaction product was taken out from the reaction tank, cooled and then pulverized to thereby obtain a non-linear polyester resin.

The non-linear polyester resin did not contain THF-insoluble matter and was found to have an acid value of 35 mgKOH/g, a hydroxyl value of 17 mgKOH/g, a Tg of 69° C., a number average molecular weight of 3,800, a weight average molecular weight of 56,000.

[Production of Masterbatch 1]

A carbon black (40 parts), Polyester 1 (60 parts) and water (30 parts) were mixed by a HENSCHEL MIXER to obtain a mixture in which pigment aggregates were dampened with water. This mixture was kneaded with a two-roll with the roll surface temperature being maintained at 130° C. for 45 minutes and then pulverized into particles of 1 mm in size by a pulverizer to thereby obtain [Masterbatch 1].

Example A1

<Aqueous Phase Production Step>

Ion exchanged water (948 parts), a 25% by mass aqueous dispersion liquid of organic resin fine particles (sodium salt of sulfate of ethylene oxide adduct of a styrene-methacrylic acid-butyl acrylate-methacrylic acid copolymer) for dispersion stabilization (42 parts), a 48.5% by mass aqueous solution of sodium dodecyldiphenyl ether sulfonate (120 parts), and ethyl acetate (90 parts) were mixed and stirred to obtain a mixture having a pH of 6.1. Then, a 10% sodium hydroxide aqueous solution was added dropwise into the mixture so as to have a pH 12.5, thereby obtaining [Aqueous Phase 1].

<Oil Phase Production Step>

Into a vessel equipped with a stirrer and a thermometer, [Linear Polyester 1] (545 parts), [paraffin wax (melting point: 74° C.)] (181 parts) and ethyl acetate (1,450 parts) were charged, the temperature thereof was increased to 80° C. while stirring and maintained at 80° C. for 5 hours, followed by cooling to 30° C. in 1 hour. Next, [Masterbatch 1] (500 parts) and ethyl acetate (100 parts) were charged into the vessel and mixed for 1 hour to obtain [Starting Material Solution 1].

[Starting Material Solution 1] (1,500 parts) was transferred to a vessel, and the pigment and wax were dispersed with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Subsequently, a 66% ethyl acetate solution of [Linear Polyester 1] (655 parts) was added to [Starting Material Solution 1] and passed once through the bead mill under the conditions described above, thereby obtaining [Pigment/Wax Dispersion Liquid 1].

[Pigment/Wax Dispersion Liquid 1] (976 parts) was mixed at 5,000 rpm for 1 minute using a TK homomixer (manufactured by Tokushu Kikai Kogyo Co. Ltd.), and then [Prepolymer 1] (88 parts) was added thereto and mixed at 5,000 rpm for 1 minute by the TK homomixer (manufactured by Tokushu Kikai Kogyo Co. Ltd.) to obtain [Oil Phase 1]. The solid content of the resulting [Oil Phase 1] was measured and found to be 52.0% by mass, and the amount of ethyl acetate to the solid content was 92% by mass.

<Core Particle Production Step>

[Aqueous Phase 1] (1,200 parts) was added to the resulting [Oil Phase 1] and then mixed using a TK homomixer with the number of revolutions of the mixer being set to 4,000 rpm to 12,000 rpm for 3 minutes while controlling the liquid temperature to be within the range of 20° C. to 23° C. by cooling in a water bath for the purpose of suppressing a temperature increase due to shearing heat caused by the mixer and then stirred for 10 minutes while controlling the number of revolutions of a Three-One Motor equipped with an anchor blade from 200 rpm to 600 rpm to thereby obtain [Core Particle Slurry 1] in which liquid droplets of the oil phase were dispersed in the aqueous phase.

<Resin Fine Particle-Attaching Step>

A mixture ([Resin Fine Particle Dispersion Liquid 1] (106 parts) and ion exchanged water (71 parts) were mixed (solid content concentration: 15%)) was added dropwise into [Core Particle Slurry 1] over 3 minutes while [Core Particle Slurry 1] being stirred using a Three-One Motor equipped with an anchor blade with the number of revolutions thereof being set from 200 rpm to 600 rpm and in a state where the liquid temperature was 22° C. After the dropping, the mixture was continuously stirred for 30 minutes while the number of revolutions being maintained from 200 rpm to 600 rpm to obtain [Composite Particle Slurry 1]. Then, 1 mL of [Composite Particle Slurry 1] was sampled and diluted to 10 mL, followed by centrifugal separation. As a result, the supernatant fluid was "transparent".

<Desolvation Step>

Into a vessel equipped with a stirrer and a thermometer, the thus obtained [Composite Particle Slurry 1] was charged, followed by desolvation at 30° C. for 8 hours while being stirred to thereby obtain [Dispersion Slurry 1]. A small amount of [Dispersion Slurry 1] was placed on a slide glass, covered with cover glasses, and then the appearance thereof was observed by an optical microscope (magnification: 200), and then colored particles uniform in size were observed. Further, 1 mL of [Dispersion Slurry 1] was sampled and diluted to 10 mL, followed by centrifugal separation. As a result, the supernatant fluid was "transparent".

<Washing/Drying Step>

After [Dispersion Slurry 1] (100 parts) was filtered under reduced pressure, (1): Ion exchanged water (100 parts) was added to the resulting filter cake and mixed at 12,000 rpm for 10 minutes using a TK homomixer, followed by a filtration treatment.

(2): Ion exchanged water (900 parts) was added into the filter cake prepared in (1), mixed (at 12,000 rpm for 30 minutes) using the TK homomixer under application of ultrasonic vibration and then filtered under reduced pressure. This treatment was repeated until the electric conductivity of the reslurry liquid became 10 μC/cm or lower.

(3): A 10% hydrochloric acid solution was added to the reslurry liquid prepared in (2) so that the pH of the reslurry liquid was 4, and then stirred using a Three-One Motor for 30 minutes, followed by a filtration treatment.

(4): Ion exchanged water (100 parts) was added to the filter cake prepared in (3) and mixed (at 12,000 rpm for 10 minutes) using the TK homomixer, followed by a filtration treatment. This treatment was repeated until the electric conductivity of the reslurry liquid became 10 μC/cm or lower, thereby obtaining [Filter Cake 1].

[Filter Cake 1] was dried with a circular air-drier at 45° C. for 48 hours and sieved with a mesh with openings of 75 μm to thereby obtain [Colored Resin Particle 1] (volume average particle diameter (Dv): 6.8 μm, Dv/Dn: 1.15).

The thus obtained [Colored Resin Particle 1] was observed through a scanning electron microscope, and it was found that resin fine particles were uniformly attached to surfaces of core particles.

Example A2

<Production of Pigment/Wax Dispersion Liquid (Oil Phase)>

Into a vessel equipped with a stirrer and a thermometer, [Non-Linear Polyester] (175 parts), [Linear Polyester 1] (430 parts), [paraffin wax (melting point: 74° C.)] (153 parts) and ethyl acetate (1,450 parts) were charged, the temperature thereof was increased to 80° C. while stirring and maintained at 80° C. for 5 hours, followed by cooling to 30° C. in 1 hour. Next, [Masterbatch 1] (410 parts) and ethyl acetate (100 parts) were charged into the vessel and mixed for 1 hour to obtain [Starting Material Solution 2]

[Starting Material Solution 2] (1,500 parts) was transferred to a vessel, and the pigment and wax were dispersed with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Subsequently, a 70% ethyl acetate solution of [Linear Polyester 1] (470 parts), a 55% ethyl acetate solution of [Linear Polyester 1] (250 parts) and ethyl acetate (95 parts) were added to [Starting Material Solution 1] and passed once through the bead mill under the conditions described above, thereby obtaining [Pigment/Wax Dispersion Liquid 2] as an oil phase. The solid content of the resulting [Pigment/Wax Dispersion Liquid 2] was measured and found to be 49.3% by mass, and the amount of ethyl acetate to the solid content was 103% by mass.

Example A22

<Production of Aqueous Phase>

Ion exchanged water (948 parts), a 25% by mass aqueous dispersion liquid of organic resin fine particles (sodium salt of sulfate of ethylene oxide adduct of a styrene-methacrylic acid-butyl acrylate-methacrylic acid copolymer) for dispersion stabilization (45 parts), and a 48.5% by mass aqueous solution of sodium dodecyldiphenyl ether disulfonate (112 parts) were mixed and stirred to obtain a mixture having a pH of 5.8. Then, a 25% ammonia solution was added dropwise into the mixture so as to have a pH 9.8, and ethyl acetate (90 parts) was added thereto and mixed and stirred, thereby obtaining [Aqueous Phase 22].

[Colored Resin Particle 22] (volume average particle diameter (Dv): 6.9 μm; Dv/Dn: 1.16) was obtained in the same manner as in Example A1, except that [Aqueous Phase 22] was used instead of [Aqueous Phase 1]. The resulting [Colored Resin Particle 22] was observed by a scanning electron microscope, and it was found that colored resin particles were uniformly attached to surfaces of core particles.

<Core Particle Production Step>

[Pigment/Wax Dispersion Liquid 2] (976 parts) was mixed at 5,000 rpm using a TK homomixer (manufactured by Tokushu Kikai Kogyo Co. Ltd.) for 1 minute, [Prepolymer 1] (88 parts) was added thereto and mixed at 5,000 rpm using the TK homomixer (manufactured by Tokushu Kikai Kogyo Co., Ltd.) for 1 minute. Subsequently, [Aqueous Phase 1] (1,200 parts) was added thereto, and mixed for 3 minutes using the TK homomixer while controlling the number of revolutions from 4,000 rpm to 12,000 rpm to thereby obtain [Colored particle Emulsion Slurry 2].

<Resin Fine Particle-Attaching Step>

A mixture ([Resin Fine Particle Dispersion Liquid 1] (106 parts) and ion exchanged water (71 parts) were mixed (solid content concentration: 15%)) was added dropwise into [Core Particle Slurry 2] over 3 minutes while [Core Particle Slurry 2] being stirred using a Three-One Motor equipped with an anchor blade with the number of revolutions thereof being set from 200 rpm to 600 rpm and in a state where the liquid temperature was 22° C. After the dropping, the mixture was continuously stirred for 30 minutes with the number of revolutions thereof being set from 200 rpm to 600 rpm to obtain [Composite Particle Slurry 2]. Then, 1 mL of [Composite Particle Slurry 2] was sampled and diluted to 10 mL, followed by centrifugal separation. As a result, the supernatant fluid was "nearly transparent".

<Desolvation Step>

Into a vessel equipped with a stirrer and a thermometer, [Composite Particle Slurry 2] was charged, followed by desolvation at 30° C. for 8 hours while being stirred to thereby obtain [Dispersion Slurry 2]. A small amount of [Dispersion Slurry 2] was placed on a slide glass, covered with cover glasses, and then the appearance thereof was observed by an optical microscope (magnification: 200), and then colored particles uniform in size were observed. Further, 1 mL of [Dispersion Slurry 2] was sampled and diluted to 10 mL, followed by centrifugal separation. As a result, the supernatant fluid was "nearly transparent".

<Washing/Drying Step>

After [Dispersion Slurry 2] (100 parts) was filtered under reduced pressure, (1): Ion exchanged water (100 parts) was added to the resulting filter cake and mixed (at 12,000 rpm for 10 minutes) using a TK homomixer, followed by a filtration treatment.

(2): Ion exchanged water (900 parts) was added into the filter cake prepared in (1), mixed (at 12,000 rpm for 30 minutes) using the TK homomixer under application of ultrasonic vibration and then filtered under reduced pressure. This treatment was repeated until the electric conductivity of the reslurry liquid became 10 μC/cm or lower.

(3): A 10% hydrochloric acid solution was added to the reslurry liquid prepared in (2) so that the pH of the reslurry liquid was 4, and then stirred using a Three-One Motor for 30 minutes, followed by a filtration treatment.

(4): Ion exchanged water (100 parts) was added to the filter cake prepared in (3) and mixed (at 12,000 rpm for 10 minutes) using the TK homomixer, followed by a filtration treatment. This treatment was repeated until the electric conductivity of the reslurry liquid became 10 μC/cm or lower, thereby obtaining [Filter Cake 2].

[Filter Cake 2] was dried with a circular air-drier at 45° C. for 48 hours and sieved with a mesh with openings of 75 μm to thereby obtain [Colored Resin Particle 2] (volume average particle diameter (Dv): 6.9 μm, Dv/Dn: 1.17). The thus obtained [Colored Resin Particle 2] was observed through a scanning electron microscope, and it was found that resin fine particles were uniformly attached to surfaces of core particles.

Example A3

A colored fine particle was produced in the same manner as in Example A1, except that no acid treatment was performed in the washing step.

Example A4

A colored fine particle was produced in the same manner as in Example A1, except that in the aqueous phase production step, a 10% potassium hydroxide aqueous solution was used instead of the 10% sodium hydroxide aqueous solution.

Example A5

A colored fine particle was produced in the same manner as in Example A2, except that in the aqueous phase production step, a 10% potassium hydroxide aqueous solution was used instead of the 10% sodium hydroxide aqueous solution.

Example A6

A colored fine particle was produced in the same manner as in Example A1, except that Resin Fine Particle Dispersion Liquid 1 to be attached to a surface of the core particle slurry was changed to Resin Fine Particle Dispersion Liquid 3.

Example A7

A colored fine particle was produced in the same manner as in Example A2, except that Resin Fine Particle Dispersion Liquid 1 to be attached to a surface of the core particle slurry was changed to Resin Fine Particle Dispersion Liquid 3.

Example A8

A colored fine particle was produced in the same manner as in Example A1, except that Resin Fine Particle Dispersion Liquid 1 to be attached to a surface of the core particle slurry was changed to Resin Fine Particle Dispersion Liquid 4.

Example A9

A colored fine particle was produced in the same manner as in Example A2, except that Resin Fine Particle Dispersion Liquid 1 to be attached to a surface of the core particle slurry was changed to Resin Fine Particle Dispersion Liquid 4.

Example A10

A colored fine particle was produced in the same manner as in Example A1, except that Resin Fine Particle Dispersion Liquid 1 to be attached to a surface of the core particle slurry was changed to Resin Fine Particle Dispersion Liquid 5.

Example A11

A colored fine particle was produced in the same manner as in Example A2, except that Resin Fine Particle Dispersion Liquid 1 to be attached to a surface of the core particle slurry was changed to Resin Fine Particle Dispersion Liquid 5.

Example A12

A colored fine particle was produced in the same manner as in Example A1, except that Linear Polyester 1 to be used in the oil phase production step was changed to Linear Polyester 2.

Example A13

A colored fine particle was produced in the same manner as in Example A2, except that Linear Polyester 1 to be used in the oil phase production step was changed to Linear Polyester 2.

Example A14

A colored fine particle was produced in the same manner as in Example A1, except that Linear Polyester 1 to be used in the oil phase production step was changed to Linear Polyester 3.

Example A15

A colored fine particle was produced in the same manner as in Example A2, except that Linear Polyester 1 to be used in the oil phase production step was changed to Linear Polyester 3.

Example A16

A colored fine particle was produced in the same manner as in Example A1, except that the 10% sodium hydroxide aqueous solution added to the aqueous phase was added to [Pigment/Wax Dispersion Liquid 1].

Example A17

A colored fine particle was produced in the same manner as in Example A2, except that the 10% sodium hydroxide aqueous solution added to the aqueous phase was added to [Pigment/Wax Dispersion Liquid 1].

Example A18

A colored fine particle was produced in the same manner as in Example A1, except that Resin Fine Particle Dispersion Liquid 1 to be attached to a surface of the core particle slurry was changed to Resin Fine Particle Dispersion Liquid 6.

Example A19

A colored fine particle was produced in the same manner as in Example A2, except that Resin Fine Particle Dispersion Liquid 1 to be attached to a surface of the core particle slurry was changed to Resin Fine Particle Dispersion Liquid 6.

Example A20

A colored fine particle was produced in the same manner as in Example A1, except that Resin Fine Particle Dispersion Liquid 1 to be attached to a surface of the core particle slurry was changed to Resin Fine Particle Dispersion Liquid 7.

Example A21

A colored fine particle was produced in the same manner as in Example A2, except that Resin Fine Particle Dispersion Liquid 1 to be attached to a surface of the core particle slurry was changed to Resin Fine Particle Dispersion Liquid 7.

Comparative Example A11

<Oil Phase Production Step>

Into a vessel equipped with a stirrer and a thermometer, [Linear Polyester 1] (545 parts), [paraffin wax (melting point: 74° C.)] (181 parts) and ethyl acetate (1,450 parts) were charged, the temperature thereof was increased to 80° C. while stirring and maintained at 80° C. for 5 hours, followed by cooling to 30° C. in 1 hour. Next, [Masterbatch 1] (500 parts) and ethyl acetate (100 parts) were charged into the vessel and mixed for 1 hour to obtain [Starting Material Solution 101]

[Starting Material Solution 101] (1,500 parts) was transferred to a vessel, and the pigment and wax were dispersed with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Subsequently, a 65% ethyl acetate solution of [Linear Polyester 1] (655 parts) was added to [Starting Material Solution 101] and passed once through the bead mill under the conditions described above, thereby obtaining [Pigment/Wax Dispersion Liquid 101] as an oil phase. Subsequently, ethyl acetate was added to [Pigment/Wax Dispersion Liquid 101] so as to adjust the solid cotent concentration (130° C., 30 minutes) of [Pigment/Wax Dispersion Liquid 101] to 50%. [Pigment/Wax Dispersion Liquid 101] (976 parts) and isophoronediamine (2.5 parts) were mixed at 5,000 rpm for 1 minute using a TK homomixer (manufactured by Tokushu Kikai Kogyo Co. Ltd.), [Prepolymer 1] (88 parts) was added thereto and then mixed at 5,000 rpm for 1 minute by the TK homomixer (manufactured by Tokushu Kikai Kogyo Co. Ltd.) to obtain [Oil Phase 101]. Note that in a charge-equivalent ratio, the solid content concentration of [Oil Phase 101] is 50% by mass, and the amount of ethyl acetate to the solid content is 100% by mass. The solid content concentration of [Oil Phase 101] was actually measured and found to be 52%, and the amount of ethyl acetate to the solid content was 92% by mass.

A colored fine particle was produced in the same manner as in Example A1, except that [Oil Phase 101] was used, and the 10% sodium hydroxide solution was not added therein.

Comparative Example A2

<Production of Pigment/Wax Dispersion Liquid (Oil Phase)>

Into a vessel equipped with a stirrer and a thermometer, [Non-Linear Polyester] (175 parts), [Linear Polyester 1] (430 parts), [paraffin wax (melting point: 74° C.)] (153 parts) and ethyl acetate (1,450 parts) were charged, the temperature thereof was increased to 80° C. while stirring and maintained at 80° C. for 5 hours, followed by cooling to 30° C. in 1 hour. Next, [Masterbatch 1] (410 parts) and ethyl acetate (100 parts) were charged into the vessel and mixed for 1 hour to obtain [Starting Material Solution 102].

[Starting Material Solution 102] (1,500 parts) was transferred to a vessel, and the pigment and wax were dispersed with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Subsequently, a 70% ethyl acetate solution of [Linear Polyester 1] (470 parts), a 55% ethyl acetate solution of [Linear Polyester 1] (250 parts) and ethyl acetate (95 parts) were added to [Starting Material Solution 102] and passed once through the bead mill under the conditions described above, thereby obtaining [Oil Phase 102]. The solid content of the resulting [Oil Phase 102] was measured and found to be 49.4% by mass, and the amount of ethyl acetate to the solid content was 102% by mass.

A colored fine particle was produced in the same manner as in Example A2, except that [Pigment/Wax Dispersion Liquid 102] (976 parts) and isophoronediamine (3.0 parts) were mixed at 5,000 rpm for 1 minute using a TK homomixer (manufactured by Tokushu Kikai Kogyo Co. Ltd.), [Prepolymer 1] (88 parts) was added thereto and mixed at 5,000 rpm for 1 minute by the TK homomixer (manufactured by Tokushu Kikai Kogyo Co. Ltd.), and then [Aqueous Phase in which the solid content and pH had been previously adjusted] (1,200 parts) was added thereto, and mixed for 3 minutes using the TK homomixer while controlling the number of revolutions from 4,000 rpm to 12,000 rpm to thereby obtain [Colored particle Emulsion Slurry 102].

Comparative Example A3

A colored fine particle was produced in the same manner as in Comparative Example A1, except that Resin Fine Particle Dispersion Liquid 1 to be attached to a surface of the core particle slurry was changed to Resin Fine Particle Dispersion Liquid 3.

Comparative Example A4

A colored fine particle was produced in the same manner as in Comparative Example A2, except that Resin Fine Particle Dispersion Liquid 1 to be attached to a surface of the core particle slurry was changed to Resin Fine Particle Dispersion Liquid 3.

Comparative Example A5

A colored fine particle was produced in the same manner as in Comparative Example A1, except that Resin Fine Particle Dispersion Liquid 1 to be attached to a surface of the core particle slurry was changed to Resin Fine Particle Dispersion Liquid 4.

Comparative Example A6

A colored fine particle was produced in the same manner as in Comparative Example A2, except that Resin Fine Particle Dispersion Liquid 1 to be attached to a surface of the core particle slurry was changed to Resin Fine Particle Dispersion Liquid 4.

Comparative Example A7

A colored fine particle was produced in the same manner as in Comparative Example A1, except that the amount of isophoronediamine added dropwise into Pigment/Wax Dispersion Liquid was changed from 2.5 parts to 2.0 parts.

Comparative Example A8

A colored fine particle was produced in the same manner as in Comparative Example A2, except that the amount of isophoronediamine added dropwise into Pigment/Wax Dispersion Liquid was changed from 3.0 parts to 2.5 parts.

Comparative Example A9

A colored fine particle was produced in the same manner as in Comparative Example A1, except that the amount of isophoronediamine added dropwise into Pigment/Wax Dispersion Liquid was changed from 2.5 parts to 3.0 parts.

Comparative Example A10

A colored fine particle was produced in the same manner as in Comparative Example A2, except that the amount of isophoronediamine added dropwise into Pigment/Wax Dispersion Liquid was changed from 3.0 parts to 3.5 parts.

Each of the colored resin particles produced in Examples A1 to A21 and Comparative Examples A1 to A10 when used as a toner was analized and evaluated as follows. The evaluation results are shown in Tables 1-A and 1-B.

Note that the description "Chain-extending of ester" in the column of "Method" in Tables 1-A and 1-B means that a method of causing a chain-extending/crosslinking reaction (chain-extension polymerization of ester) of prepolymer, which is one of dissolution suspension methods, was employed. More specifically, the description "Chain-extending of ester" means a reaction method in which when a polyester with its terminal being modified with isocyanate is dissolved together with an unmodified polyester in an organic solvent and these polyesters are dispersed in an aqueous dispersion liquid, toner particles are granulated while performing a chain-extending reaction of isocyanate, as seen in Example A1.

<Toner Adhesion onto Regulating Blade>

Using IPSIO SP C220 (manufactured by Ricoh Companry Ltd.), 2,000 sheets of a predetermined print pattern having a print ratio of 6% were continuously printed under N/N environment (23° C., 45%). After the continuous printing (after duration test), the appearance of a developing roller in the developing unit in the copier and the appearance of copied images were visually observed and evaluated. The evaluation criteria are as follows:

A: No image streak and no nonuniform image density were observed on the developing roller.

B: Although image steak or nonuniform image density slightly occurred on the developing roller, there was no vertical streak on the copied images, and hence no problem in practical use.

C: A number of image streaks or a number of nonuniform image portions were observed on the developing roller, and vertical, streaky image dropouts occurred, and hence there were problems in practical use.

Note that the grades "A" and "B" were determined as acceptable.

<Contamination of Photoconductor>

Using IPSIO SP C220 (manufactured by Ricoh Company Ltd.), 2,000 sheets of a predetermined print pattern having a print ratio of 6% were continuously printed under N/N environment (23° C., 45%). Contamination caused by toner "L*" in the initial stage (before duration test) and after continuously printing 2,000 sheets (after duration test) was determined by a tape transfer method. The tape transfer method is a method in which a mending tape (produced by Sumitomo 3M Co., Ltd.) is attached to toner present on a photoconductor so as to transfer the fogged toner to the tape, this mending tape and a toner-untransferred mending tape are each attached to a white paper sheet, reflection densities thereof are measured by an X-RITE939, and a difference "L*" in reflection density between these tapes is determined as a reflection density of the contamination.

A: The rate of change L* between the initial state and the after-duration test was less than 2%.

B: The rate of change L* between the initial state and the after-duration test was 2% or more and less than 5%.

C: The rate of change L* between the initial state and the after-duration test was 5% or more.

Note that the grades "A" and "B" were determined as acceptable.

<Evaluation Grades of Supernatant Fluid>

Whether or not resin fine particles were attached to surfaces of core particles was determined and evaluated by determining the transparency of supernatant fluid of resin fine particles obtained through a centrifugal separator. The following describes the evaluation method.

Specifically, 1 mL of the composite particle slurry, in which resin fine particles were added dropwise into a core particle slurry, was sampled and diluted to 10 mL, and this sample was subjected to centrifugal separation. Subsequently, visual inspection liquids of the following five-graded evaluation were produced to thereby performing visual inspection evaluation.

A: The supernatant fluid was "transparent".

B: The supernatant fluid was "nearly transparent".

C: The supernatant fluid was "slightly white turbid".

D: The supernatant fluid was "considerably white turbid".

E: The supernatant fluid was "a completely white turbid liquid".

TABLE 1-A

| | Inorganic base | | Resin component | | | | | | | | |
|---|---|---|---|---|---|---|---|---|---|---|---|
| | Type | Added in | Linear polyester | Other | Polyamine compound | Shell agent | Acid treatment | Supernatant fluid | Contamination of photoconductor | Toner adhesion to blade | Method |
| Ex. A1 | NaOH | aqueous phase | AV22 | Prepolymer | — | FP-1 | Performed | A | A | A | Ester elongation |
| Ex. A2 | NaOH | aqueous phase | AV22 | Non-linear P | — | FP-1 | Performed | B | A | B | Dissolution suspension |
| Ex. A3 | NaOH | aqueous phase | AV22 | Prepolymer | — | FP-1 | Not performed | B | B | B | Ester elongation |
| Ex. A4 | KOH | aqueous phase | AV22 | Prepolymer | — | FP-1 | Performed | B | A | A | Ester elongation |
| Ex. A5 | KOH | aqueous phase | AV22 | Non-linear P | — | FP-1 | Performed | C | A | B | Dissolution suspension |
| Ex. A6 | NaOH | aqueous phase | AV22 | Prepolymer | — | FP-3 | Performed | A | A | A | Ester elongation |
| Ex. A7 | NaOH | aqueous phase | AV22 | Non-linear P | — | FP-3 | Performed | A | A | A | Dissolution suspension |
| Ex. A8 | NaOH | aqueous phase | AV22 | Prepolymer | — | FP-4 | Performed | C | B | B | Ester elongation |
| Ex. A9 | NaOH | aqueous phase | AV22 | Non-linear P | — | FP-4 | Performed | C | B | B | Dissolution suspension |

TABLE 1-A-continued

| | Inorganic base | | Resin component | | Polyamine | Shell | Acid | Superna- | Contamination of | Toner adhesion | |
|---|---|---|---|---|---|---|---|---|---|---|---|
| | Type | Added in | Linear polyester | Other | compound | agent | treatment | tant fluid | photoconductor | to blade | Method |
| Ex. A10 | NaOH | aqueous phase | AV22 | Prepolymer | — | FP-5 | Performed | C | B | B | Ester elongation |
| Ex. A11 | NaOH | aqueous phase | AV22 | Non-linear P | — | FP-5 | Performed | C | B | B | Dissolution suspension |
| Ex. A12 | NaOH | aqueous phase | AV15 | Prepolymer | — | FP-1 | Performed | C | A | B | Ester elongation |
| Ex. A13 | NaOH | aqueous phase | AV15 | Non-linear P | — | FP-1 | Performed | C | B | B | Dissolution suspension |
| Ex. A14 | NaOH | aqueous phase | AV25 | Prepolymer | — | FP-1 | Performed | C | A | B | Ester elongation |
| Ex. A15 | NaOH | aqueous phase | AV25 | Non-linear P | — | FP-1 | Performed | C | B | B | Dissolution suspension |
| Ex. A16 | NaOH | oil phase | AV22 | Prepolymer | — | FP-1 | Performed | B | A | A | Chain-extracting ester |
| Ex. A17 | NaOH | oil phase | AV22 | Non-linear P | — | FP-1 | Performed | B | B | B | Dissolution suspension |
| Ex. A18 | NaOH | aqueous phase | AV22 | Prepolymer | — | FP-6 | Performed | B | A | A | Ester elongation |
| Ex. A19 | NaOH | aqueous phase | AV22 | Non-linear P | — | FP-6 | Performed | B | A | A | Dissolution suspension |
| Ex. A20 | NaOH | aqueous phase | AV22 | Prepolymer | — | FP-7 | Performed | A | A | A | Ester elongation |
| Ex. A21 | NaOH | aqueous phase | AV22 | Non-linear P | — | FP-7 | Performed | A | A | A | Dissolution suspension |
| Ex. A22 | $NH_3$aq | aqueous phase | AV22 | Prepolymer | Added | FP-1 | Performed | A | B | A | Ester elongation |

TABLE 1-B

| | Inorganic base | | Resin component | | Polyamine | Shel | Acid | Superna- | Contamination of | Toner adhesion | |
|---|---|---|---|---|---|---|---|---|---|---|---|
| | Type | Added in | Linear polyester | Other | compound | agent | treatment | tant fluid | photoconductor | to blade | Method |
| Comp. Ex. A1 | — | — | AV22 | Prepolymer | Added moderately | FP-1 | Performed | D | C | C | Ester elongation |
| Comp. Ex. A2 | — | — | AV22 | Non-linear P | Added moderately | FP-1 | Performed | D | C | C | Dissolution suspension |
| Comp. Ex. A3 | — | — | AV22 | Prepolymer | Added moderately | FP-3 | Performed | C | B | C | Ester elongation |
| Comp. Ex. A4 | — | — | AV22 | Non-linear P | Added moderately | FP-3 | Performed | C | B | C | Dissolution suspension |
| Comp. Ex. A5 | — | — | AV22 | Prepolymer | Added moderately | FP-4 | Performed | E | C | C | Ester elongation |
| Comp. Ex. A6 | — | — | AV22 | Non-linear P | Added moderately | FP-4 | Performed | E | C | C | Dissolution suspension |
| Comp. Ex. A7 | — | — | AV22 | Prepolymer | Added in small amount | FP-1 | Performed | D | C | C | Ester elongation |
| Comp. Ex. A8 | — | — | AV22 | Non-linear P | Added in small amount | FP-1 | Performed | D | C | C | Dissolution suspension |
| Comp. Ex. A9 | — | — | AV22 | Prepolymer | Added in large amount | FP-1 | Performed | D | C | C | Ester elongation |
| Comp. Ex. A10 | — | — | AV22 | Non-linear P | Added in large amount | FP-1 | Performed | D | C | C | Dissolution suspension |

Meaning of symbols described in Tables 1-A and 1-B are as follows:

FP: Resin Fine Particle Dispersion

AV22 means that the cored resin particle has an acid value of 22 mgKOH/g.

Non-linear P: Non-Linear Polyester

With the above-mentioned manner, further details of adhesion properties of resin fine particles were examined.

[Vinyl-Based Resin Fine Particle Dispersion Liquid 1]

Into a reaction vessel equipped with a condenser, a stirrer and a nitrogen inlet tube, sodium dodecyl sulfate (0.7 parts), and ion exchanged water (498 parts) were poured, dissolved by heating to 80° C. while being stirred, then a solution (in which potassium persulfate (2.6 parts) was dissolved in ion exchanged water (104 parts)) was added to the mixture, and 15 minutes later, a monomer mixture liquid (styrene monomer (200 parts) and n-octanethiol (4.2 parts)) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Vinyl-Based Resin Fine Particle Dispersion Liquid 1. Then, 2 mL of the thus obtained disersion liquid was taken into a petri dish, and the dispersion medium was evaporated to obtain a dried product. The dried product was measured and found to have a number average molecular weight of 8,300, a weight average molecular weight of 16,900, a glass transition temperature (Tg) of 83° C., and a volume average particle diameter (Mv) of 135 nm.

[Vinyl-Based Resin Fine Particle Dispersion Liquid 2]

Into a reaction vessel equipped with a condenser, a stirrer and a nitrogen inlet tube, sodium dodecyl sulfate (0.7 parts), and ion exchanged water (498 parts) were poured, dissolved by heating to 80° C. while being stirred, then a solution (in which potassium persulfate (2.6 parts) was dissolved in ion exchanged water (104 parts)) was added to the mixture, and 15 minutes later, a monomer mixture liquid (styrene monomer (191 parts), butyl acrylate (4 parts), methacrylic acid (5 parts) and n-octanethiol (4.2 parts)) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Vinyl-Based Resin Fine Particle Dispersion Liquid 2. Then, 2 mL of the thus obtained disersion liquid was taken into a petri dish, and the dispersion medium was evaporated to obtain a dried product. The dried product was measured and found to have a number average molecular weight of 8,000, a weight average molecular weight of 16,200, a glass transition temperature (Tg) of 81° C.

[Vinyl-Based Resin Fine Particle Dispersion Liquid 3]

Into a reaction vessel equipped with a condenser, a stirrer and a nitrogen inlet tube, sodium dodecyl sulfate (0.7 parts), and ion exchanged water (498 parts) were poured, dissolved by heating to 80° C. while being stirred, then a solution (in which potassium persulfate (2.6 parts) was dissolved in ion exchanged water (104 parts)) was added to the mixture, and 15 minutes later, a monomer mixture liquid (styrene monomer (184 parts), butyl acrylate (6 parts), methacrylic acid (10 parts) and n-octanethiol (4.2 parts)) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Vinyl-Based Resin Fine Particle Dispersion Liquid 3. Then, 2 mL of the thus obtained disersion liquid was taken into a petri dish, and the dispersion medium was evaporated to obtain a dried product. The dried product was measured and found to have a number average molecular weight of 8,400, a weight average molecular weight of 17,200, a glass transition temperature (Tg) of 82° C.

[Vinyl-Based Resin Fine Particle Dispersion Liquid 4]

Into a reaction vessel equipped with a condenser, a stirrer and a nitrogen inlet tube, sodium dodecyl sulfate (0.7 parts), and ion exchanged water (498 parts) were poured, dissolved by heating to 80° C. while being stirred, then a solution (in which potassium persulfate (2.6 parts) was dissolved in ion exchanged water (105 parts)) was added to the mixture, and 15 minutes later, a monomer mixture liquid (styrene monomer (170 parts), butyl acrylate (12 parts), methacrylic acid (18 parts) and n-octanethiol (4.2 parts)) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Vinyl-Based Resin Fine Particle Dispersion Liquid 4. Then, 2 mL of the thus obtained disersion liquid was taken into a petri dish, and the dispersion medium was evaporated to obtain a dried product. The dried product was measured and found to have a number average molecular weight of 8,100, a weight average molecular weight of 16,500, a glass transition temperature (Tg) of 85° C.

[Vinyl-Based Resin Fine Particle Dispersion Liquid 5]

Into a reaction vessel equipped with a condenser, a stirrer and a nitrogen inlet tube, sodium dodecyl sulfate (0.7 parts), and ion exchanged water (498 parts) were poured, dissolved by heating to 80° C. while being stirred, then a solution (in which potassium persulfate (2.7 parts) was dissolved in ion exchanged water (106 parts)) was added to the mixture, and 15 minutes later, a monomer mixture liquid (styrene monomer (120 parts), butyl acrylate (30 parts), methacrylic acid (50 parts) and n-octanethiol (4.3 parts)) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Vinyl-Based Resin Fine Particle Dispersion Liquid 5. Then, 2 mL of the thus obtained disersion liquid was taken into a petri dish, and the dispersion medium was evaporated to obtain a dried product. The dried product was measured and found to have a number average molecular weight of 8,200, a weight average molecular weight of 17,500, a glass transition temperature (Tg) of 80° C.

[Vinyl-Based Resin Fine Particle Dispersion Liquid 6]

Into a reaction vessel equipped with a condenser, a stirrer and a nitrogen inlet tube, sodium dodecyl sulfate (0.7 parts), and ion exchanged water (498 parts) were poured, dissolved by heating to 80° C. while being stirred, then a solution (in which potassium persulfate (2.6 parts) was dissolved in ion exchanged water (103 parts)) was added to the mixture, and 15 minutes later, a monomer mixture liquid (styrene monomer (182 parts), 2-ethylhexylacrylate (4 parts), acrylic acid (4 parts), 4-methylstyrene (10 parts) and n-octanethiol (4.2 parts)) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Vinyl-Based Resin Fine Particle Dispersion Liquid 6. Then, 2 mL of the thus obtained disersion liquid was taken into a petri dish, and the dispersion medium was evaporated to obtain a dried product. The dried product was measured and found to have a number average molecular weight of 7,100, a weight average molecular weight of 15,200, a glass transition temperature (Tg) of 85° C.

[Vinyl-Based Resin Fine Particle Dispersion Liquid 7]

Into a reaction vessel equipped with a condenser, a stirrer and a nitrogen inlet tube, sodium dodecyl sulfate (0.7 parts), and ion exchanged water (498 parts) were poured, dissolved by heating to 80° C. while being stirred, then a solution (in which potassium persulfate (2.7 parts) was dissolved in ion exchanged water (108 parts)) was added to the mixture, and 15 minutes later, a monomer mixture liquid (styrene monomer (148 parts), 2-ethylhexylacrylate (10 parts), acrylic acid (30 parts), 4-methylstyrene (12 parts) and n-octanethiol (4.4 parts)) was added dropwise over 90 minutes. Subsequently, the temperature of the reaction system was maintained at 80° C. for 60 minutes to be subjected to polymerization reaction.

Thereafter, the reaction system was cooled, thereby obtaining white-color Vinyl-Based Resin Fine Particle Dispersion Liquid 7. Then, 2 mL of the thus obtained disersion liquid was taken into a petri dish, and the dispersion medium was evaporated to obtain a dried product. The dried product was measured and found to have a number average molecular weight of 7,000, a weight average molecular weight of 14,900, a glass transition temperature (Tg) of 80° C.

The monomer composition of each vinyl-based resin fine particle, molecular weight, glass transition temperature and particle diameter of Vinyl-Based Resin Fine Particle Dispersion Liquids 1 to 7 obtained above are shown in Table 2.

TABLE 2

| Vinyl-Based Resin Fine Particle Dispersion Liquid No. | Composition of monomer: Styrene | 4-methyl styrene | Butyl acrylate | 2-ethylhexyl acrylate | Methacrylic acid | Acrylic acid | Molecular weight: Mn | Mw | Glass transition temperature Tg (° C.) |
|---|---|---|---|---|---|---|---|---|---|
| Dispersion Liquid 1 | 100 | | 0 | | 0 | | 8,300 | 16,900 | 83 |
| Dispersion Liquid 2 | 95.5 | | 2 | | 2.5 | | 8,000 | 16,200 | 81 |
| Dispersion Liquid 3 | 92 | | 3 | | 5 | | 8,400 | 17,200 | 82 |
| Dispersion Liquid 4 | 85 | | 6 | | 9 | | 8,100 | 16,500 | 85 |
| Dispersion Liquid 5 | 60 | | 15 | | 25 | | 8,200 | 17,500 | 80 |
| Dispersion Liquid 6 | 91 | 5 | | 2 | | 2 | 7,100 | 15,200 | 85 |
| Dispersion Liquid 7 | 74 | 6 | | 5 | | 15 | 7,000 | 14,900 | 80 |

[Synthesis of Polyester 1]

Into a reaction vessel equipped with a condenser, a stirrer and a nitrogen inlet tube, an ethylene oxide (2 mol) adduct of bisphenol A (229 parts), a propylene oxide (2 mol) adduct of bisphenol A (529 parts), terephthalic acid (208 parts), adipic acid (46 parts) and dibutyltin oxide (2 parts) were added, and reacted under normal pressure at 230° C. for 8 hours. Next, the reaction system was reacted under reduced pressure of 10 mmHg to 15 mmHg for 5 hours, and then trimellitic anhydride (44 parts) was added to the reaction vessel and further reacted at 180° C. under normal pressure for 2 hours to thereby synthesize [Polyester 1].

The thus obtained [Linear Polyester 1] was found to have a number average molecular weight of 2,500, a weight average molecular weight of 6,700, a glass transition temperature of 43° C. and an acid value of 25 mgKOH/g.

[Synthesis of Polyester 2]

Into a reaction vessel equipped with a condenser, a stirrer and a nitrogen inlet tube, an ethylene oxide (2 mol) adduct of bisphenol A (270 parts), a propylene oxide (2 mol) adduct of bisphenol A (497 parts), terephthalic acid (110 parts), isophthalic acid (102 parts), adipic acid (44 parts) and dibutyltin oxide (2 parts) were added, and reacted under normal pressure at 230° C. for 9 hours. Next, the reaction system was reacted under reduced pressure of 10 mmHg to 18 mmHg for 7 hours, and then trimellitic anhydride (40 parts) was added to the reaction vessel and further reacted at 180° C. under normal pressure for 2 hours to thereby synthesize [Polyester 2]. The thus obtained [Linear Polyester 2] was found to have a number average molecular weight of 3,000, a weight average molecular weight of 8,600, a glass transition temperature of 49° C. and an acid value of 22 mgKOH/g.

[Synthesis of Polyester 3]

Into a reaction vessel equipped with a condenser, a stirrer and a nitrogen inlet tube, an ethylene oxide (2 mol) adduct of bisphenol A (218 parts), a propylene oxide (2 mol) adduct of bisphenol A (460 parts), terephthalic acid (140 parts), isophthalic acid (145 parts), and dibutyltin oxide (2 parts) were added, and reacted under normal pressure at 230° C. for 8 hours. Next, the reaction system was reacted under reduced pressure of 10 mmHg to 18 mmHg for 6 hours, and then trimellitic anhydride (24 parts) was added to the reaction vessel and further reacted at 180° C. under normal pressure for 2 hours to thereby synthesize [Polyester 3]. The thus obtained [Linear Polyester 3] was found to have a number average molecular weight of 7,600, a weight average molecular weight of 21,000, a glass transition temperature of 57° C. and an acid value of 15 mgKOH/g.

[Synthesis of Prepolymer]

Into a reaction vessel equipped with a condenser, a stirrer and a nitrogen inlet tube, an ethylene oxide (2 mol) adduct of bisphenol A (682 parts), a propylene oxide (2 mol) adduct of bisphenol A (81 parts), terephthalic acid (283 parts), trimellitic anhydride (22 parts), and dibutyltin oxide (2 parts) were added, reacted under normal pressure at 230° C. for 8 hours, and further reacted under reduced pressure of 10 mmHg to 15 mmHg for 5 hours to thereby obtain [Intermediate Polyester 1]. [Intermediate Polyester 1] was found to have a number average molecular weight of 2,100, a weight average molecular weight of 9,500, a glass transition temperature of 55° C., an acid value of 0.5 mgKOH/g and a hydroxyl value of 49 mgKOH/g.

Next, into another reaction vessel equipped with a condenser, a stirrer and a nitrogen inlet tube, [Intermediate Polyester 1] (411 parts), isophoronediisocyanate (89 parts) and ethyl acetate (500 parts) were added and reacted at 100° C. for 5 hours to thereby obtain isocyanate-modified polyester [Prepolymer 1]. [Prepolymer 1] was found to have a free isocyanate content of 1.53% by mass.

[Production of Masterbatch 1]

A carbon black (40 parts), Polyester 1 (60 parts) and water (30 parts) were mixed by a HENSCHEL MIXER to obtain a mixture in which pigment aggregates were dampened with water. This mixture was kneaded with a two-roll with the roll surface temperature being maintained at 130° C. for 45 minutes and then pulverized into particles of 1 mm in size by a pulverizer to thereby obtain [Masterbatch 1].

Example B1

<Aqueous Phase Production Step>

Ion exchanged water (970 parts), a 25% by mass aqueous dispersion liquid of organic resin fine particles (sodium salt of sulfate of ethylene oxide adduct of a styrene-methacrylic acid-butyl acrylate-methacrylic acid copolymer) for dispersion stabilization (40 parts), a 48.5% by mass aqueous solution of sodium dodecyldiphenyl ether sulfonate (95 parts), and ethyl acetate (98 parts) were mixed and stirred to obtain a mixture having a pH of 6.2. Then, a 10% sodium hydroxide aqueous solution was added dropwise into the mixture so as to have a pH 9.5, thereby obtaining [Aqueous Phase 1].

<Oil Phase Production Step>

Into a vessel equipped with a stirrer and a thermometer, [Polyester 1] (545 parts), [paraffin wax (melting point: 74° C.)] (181 parts) and ethyl acetate (1,450 parts) were charged, the temperature thereof was increased to 80° C. while stirring and maintained at 80° C. for 5 hours, followed by cooling to 30° C. in 1 hour. Next, [Masterbatch 1] (500 parts) and ethyl acetate (100 parts) were charged into the vessel and mixed for 1 hour to obtain [Starting Material Solution 1].

[Starting Material Solution 1] (1,500 parts) was transferred to a vessel, and the pigment and wax were dispersed with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Subsequently, a 66% ethyl acetate solution of [Polyester 1] (655 parts) was added to [Starting Material Solution 1] and passed once through the bead mill under the conditions described above, thereby obtaining

[Pigment/Wax Dispersion Liquid 1].

[Pigment/Wax Dispersion Liquid 1] (976 parts) was mixed at 5,000 rpm for 1 minute using a TK homomixer (manufactured by Tokushu Kikai Kogyo Co. Ltd.), and then [Isocyanate-Modified Polyester 1] (88 parts) was added thereto and mixed at 5,000 rpm for 1 minute by the TK homomixer (manufactured by Tokushu Kikai Kogyo Co. Ltd.) to obtain [Oil Phase 1].

The solid content of the resulting [Oil Phase 1] was measured and found to be 52.0% by mass, and the amount of ethyl acetate to the solid content was 92% by mass.

<Core Particle Production Step>

[Aqueous Phase 1] (1,200 parts) was added to the resulting [Oil Phase 1] and then mixed using a TK homomixer with the number of revolutions of the mixer being set to 8,000 rpm to 15,000 rpm for 2 minutes while controlling the liquid temperature to be within the range of 20° C. to 23° C. by cooling in a water bath for the purpose of suppressing a temperature increase due to shearing heat caused by the mixer and then stirred for 10 minutes while controlling the number of revolutions of a Three-One Motor equipped with an anchor blade from 130 rpm to 350 rpm to thereby obtain [Core Particle Slurry 1] in which liquid droplets of the oil phase were dispersed in the aqueous phase.

<Resin Fine Particle-Attaching Step>

A mixture ([Vinyl-Based Resin Fine Particle Dispersion Liquid 1] (106 parts) and ion exchanged water (71 parts) were mixed (solid content concentration: 15%)) was added dropwise into [Core Particle Slurry 1] over 3 minutes while [Core Particle Slurry 1] being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while the number of revolutions being maintained from 200 rpm to 450 rpm to obtain [Composite Particle Slurry 1]. Then, 1 mL of [Composite Particle Slurry 1] was sampled and diluted to 10 mL, followed by centrifugal separation. As a result, the supernatant fluid was "transparent".

<Desolvation Step>

Into a vessel equipped with a stirrer and a thermometer, [Composite Particle Slurry 1] was charged, followed by desolvation at 30° C. for 8 hours while being stirred to thereby obtain [Dispersion Slurry 1]. A small amount of [Dispersion Slurry 1] was placed on a slide glass, covered with cover glasses, and then the appearance thereof was observed by an optical microscope (magnification: 200). As a result, aggregated particles (like the case where some parts of colored particles appear aggregated) and transparent particles containing no colorant were not observed, and colored particles uniform in size were observed (hereinafter, colored resin particles in such a state simply called "uniform colored particle(s)". Further, 1 mL of [Dispersion Slurry 1] was sampled and diluted to 10 mL, followed by centrifugal separation. As a result, the supernatant fluid was "transparent".

<Washing/Drying Step>

After [Dispersion Slurry 1] (100 parts) was filtered under reduced pressure, (1): Ion exchanged water (100 parts) was added to the resulting filter cake and mixed (at 12,000 rpm for 10 minutes) using a TK homomixer, followed by a filtration treatment.

(2): Ion exchanged water (900 parts) was added into the filter cake prepared in (1), mixed (at 12,000 rpm for 30 minutes) using the TK homomixer under application of ultrasonic vibration and then filtered under reduced pressure. This treatment was repeated until the electric conductivity of the reslurry liquid became 10 μC/cm or lower.

(3): A 10% hydrochloric acid solution was added to the reslurry liquid prepared in (2) so that the pH of the reslurry liquid was 4, and then stirred using a Three-One Motor for 30 minutes, followed by a filtration treatment.

(4): Ion exchanged water (100 parts) was added to the filter cake prepared in (3) and mixed (at 12,000 rpm for 10 minutes) using the TK homomixer, followed by a filtration treatment. This treatment was repeated until the electric conductivity of the reslurry liquid became 10 μC/cm or lower, thereby obtaining [Filter Cake 1].

[Filter Cake 1] was dried with a circular air-drier at 45° C. for 48 hours and sieved with a mesh with openings of 75 μm to thereby obtain [Colored Resin Particle 1] (volume average particle diameter (Dv): 6.1 μm, Dv/Dn: 1.14). The thus obtained [Colored Resin Particle 1] was observed through a scanning electron microscope, and it was found that vinyl resin fine particles were uniformly attached to surfaces of core particles.

Example B2

<Resin Fine Particle-Attaching Step>

A mixture ([Vinyl-Based Resin Fine Particle Dispersion Liquid 2] (106 parts) and ion exchanged water (71 parts) were mixed (solid content concentration: 15%)) was added dropwise into a core particle slurry (which was produced in the same manner as in Example B1) over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 2]. Then, 1 mL of [Composite Particle Slurry 2] was sampled and diluted to 10 mL, followed by centrifugal separation. As a result, the supernatant fluid was "nearly transparent".

<Desolvation Step>

Into a vessel equipped with a stirrer and a thermometer, [Composite Particle Slurry 2] was charged, followed by desolvation at 30° C. for 8 hours while being stirred to thereby obtain [Dispersion Slurry 2]. A small amount of [Dispersion Slurry 2] was placed on a slide glass, covered with cover glasses, and then the appearance thereof was observed by an optical microscope (magnification: 200), and then colored particles uniform in size were observed. Further, 1 mL of [Dispersion Slurry 2] was sampled and diluted to 10 mL, followed by centrifugal separation. As a result, the supernatant fluid appeared to be slightly white turbid but nearly transparent.

Thereafter, [Dispersion Slurry 2] was washed and dried in the same manner as in Example B1, and the resulting [Colored Resin Particle 2] was observed by a scanning electron microscope. As a result, vinyl resin particles were uniformly attached to surfaces of core particles.

Example B3

<Resin Fine Particle-Attaching Step>

A mixture ([Vinyl-Based Resin Fine Particle Dispersion Liquid 3] (106 parts) and ion exchanged water (71 parts) were mixed (solid content concentration: 15%)) was added dropwise into a core particle slurry (which was produced in the same manner as in Example B1) over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 3]. Then, 1 mL of [Composite Particle Slurry 3] was sampled and diluted to 10 mL, followed by centrifugal separation. As a result, the supernatant fluid was transparent.

<Desolvation Step>

Into a vessel equipped with a stirrer and a thermometer, [Composite Particle Slurry 3] was charged, followed by desolvation at 30° C. for 8 hours while being stirred to thereby obtain [Dispersion Slurry 3]. A small amount of [Dispersion Slurry 3] was placed on a slide glass, covered with cover glasses, and then the appearance thereof was observed by an optical microscope (magnification: 200), and then colored particles uniform in size were observed. Further, 1 mL of [Dispersion Slurry 3] was sampled and diluted to 10 mL, followed by centrifugal separation. As a result, the supernatant fluid was white turbid and semi-transparent.

Thereafter, [Dispersion Slurry 3] was washed and dried in the same manner as in Example B1, and the resulting [Colored Resin Particle 3] was observed by a scanning electron microscope. As a result, vinyl resin particles were uniformly attached to surfaces of core particles.

Example B4

<Production of Aqueous Phase>

Ion exchanged water (970 parts), a 25% by mass aqueous dispersion liquid of organic resin fine particles (sodium salt of sulfate of ethylene oxide adduct of a styrene-methacrylic acid-butyl acrylate-methacrylic acid copolymer) for dispersion stabilization (29 parts), a 48.5% by mass aqueous solution of sodium dodecyldiphenyl ether sulfonate (95 parts), and ethyl acetate (98 parts) were mixed and stirred to obtain a mixture having a pH of 6.2. Then, a 10% sodium hydroxide aqueous solution was added dropwise into the mixture so as to have a pH 9.1, thereby obtaining [Aqueous Phase 4].

<Production of Pigment/Wax Dispersion Liquid (Oil Phase)>

Into a vessel equipped with a stirrer and a thermometer, [Polyester 2] (175 parts), [Polyester 3] (430 parts), [paraffin wax (melting point: 74° C.)] (153 parts) and ethyl acetate (1,450 parts) were charged, the temperature thereof was increased to 80° C. while stirring and maintained at 80° C. for 5 hours, followed by cooling to 30° C. in 1 hour. Next, [Masterbatch 1] (410 parts) and ethyl acetate (100 parts) were charged into the vessel and mixed for 1 hour to obtain [Starting Material Solution 4]

[Starting Material Solution 4] (1,500 parts) was transferred to a vessel, and the pigment and wax were dispersed with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Subsequently, a 70% ethyl acetate solution of [Polyester 2] (470 parts), a 55% ethyl acetate solution of [Polyester 3] (250 parts) and ethyl acetate (95 parts) were added to [Starting Material Solution 4] and passed once through the bead mill under the conditions described above, thereby obtaining [Oil Phase 4]. The solid content of the resulting [Oil Phase 4] was measured and found to be 49.3% by mass, and the amount of ethyl acetate to the solid content was 103% by mass.

<Core Particle Production Step>

[Pigment/Wax Dispersion Liquid 4] (976 parts) was mixed at 5,000 rpm using a TK homomixer (manufactured by Tokushu Kikai Kogyo Co. Ltd.) for 1 minute, [Prepolymer 1] (88 parts) was added thereto and mixed at 5,000 rpm using the TK homomixer (manufactured by Tokushu Kikai Kogyo Co., Ltd.) for 1 minute. Subsequently, [Aqueous Phase 4] (1,200 parts) was added thereto, and mixed for 2 minutes using the TK homomixer while controlling the number of revolutions from 8,000 rpm to 15,000 rpm to thereby obtain [Colored particle Emulsion Slurry 4].

<Resin Fine Particle-Attaching Step>

A mixture ([Vinyl-Based Resin Fine Particle Dispersion Liquid 1] (106 parts) and ion exchanged water (71 parts) were mixed (solid content concentration: 15%)) was added dropwise into [Colored particle Emulsion Slurry 4] over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 4]. Then, 1 mL of [Composite Particle Slurry 4] was sampled and diluted to 10 mL, followed by centrifugal separation. As a result, the supernatant fluid was transparent.

<Desolvation Step>

Into a vessel equipped with a stirrer and a thermometer, the thus obtained [Composite Particle Slurry 4] was charged, followed by desolvation at 30° C. for 8 hours while being stirred to thereby obtain [Dispersion Slurry 4]. A small amount of [Dispersion Slurry 4] was placed on a slide glass, covered with cover glasses, and then the appearance thereof was observed by an optical microscope (magnification: 200), and then colored particles uniform in size were observed. Further, 1 mL of [Dispersion Slurry 4] was sampled and diluted to 10 mL, followed by centrifugal separation. As a result, the supernatant fluid was transparent.

<Washing/Drying Step>

After [Dispersion Slurry 4] (100 parts) was filtered under reduced pressure, (1): Ion exchanged water (100 parts) was added to the resulting filter cake and mixed (at 12,000 rpm for 10 minutes) using a TK homomixer, followed by a filtration treatment.

(2): Ion exchanged water (900 parts) was added into the filter cake prepared in (1), mixed (at 12,000 rpm for 30 minutes) using the TK homomixer under application of ultrasonic vibration and then filtered under reduced pressure. This treatment was repeated until the electric conductivity of the reslurry liquid became 10 μC/cm or lower.

(3): A 10% hydrochloric acid solution was added to the reslurry liquid prepared in (2) so that the pH of the reslurry liquid was 4, and then stirred using a Three-One Motor for 30 minutes, followed by a filtration treatment.

(4): Ion exchanged water (100 parts) was added to the filter cake prepared in (3) and mixed (at 12,000 rpm for 10 minutes) using the TK homomixer, followed by a filtration treatment. This treatment was repeated until the electric conductivity of the reslurry liquid became 10 μC/cm or lower, thereby obtaining [Filter Cake 4].

[Filter Cake 4] was dried with a circular air-drier at 45° C. for 48 hours and sieved with a mesh with openings of 75 phi to thereby obtain [Colored Resin Particle 4] (volume average particle diameter (Dv): 6.2 pan, Dv/Dn: 1.13). The thus obtained [Colored Resin Particle 4] was observed through a scanning electron microscope, and it was found that vinyl resin fine particles were uniformly attached to surfaces of core particles.

Example B5

<Resin Fine Particle-Attaching Step>

A mixture ([Vinyl-Based Resin Fine Particle Dispersion Liquid 2] (106 parts) and ion exchanged water (71 parts) were mixed (solid content concentration: 15%)) was added dropwise into a core particle slurry (which was produced in the same manner as in Example B4) over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 5]. Then, 1 mL of [Composite Particle Slurry 5] was sampled and diluted to 10 mL, followed by centrifugal separation. As a result, the supernatant fluid was transparent.

<Desolvation Step>

Into a vessel equipped with a stirrer and a thermometer, [Composite Particle Slurry 5] was charged, followed by desolvation at 30° C. for 8 hours while being stirred to thereby obtain [Dispersion Slurry 5]. A small amount of [Dispersion Slurry 5] was placed on a slide glass, covered with cover glasses, and then the appearance thereof was observed by an optical microscope (magnification: 200), and then colored particles uniform in size were observed. Further, 1 mL of [Dispersion Slurry 5] was sampled and diluted to 10 mL, followed by centrifugal separation. As a result, the supernatant fluid was slightly white turbid but nearly transparent.

Thereafter, [Dispersion Slurry 5] was washed and dried in the same manner as in Example B3, and the resulting [Colored Resin Particle 5] was observed by a scanning electron microscope. As a result, vinyl resin particles were uniformly attached to surfaces of core particles.

Example B6

<Resin Fine Particle-Attaching Step>

A mixture ([Vinyl-Based Resin Fine Particle Dispersion Liquid 3] (106 parts) and ion exchanged water (71 parts) were mixed (solid content concentration: 15%)) was added dropwise into a core particle slurry (which was produced in the same manner as in Example B4) over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 6]. Then, 1 mL of [Composite Particle Slurry 6] was sampled and diluted to 10 mL, followed by centrifugal separation. As a result, the supernatant fluid was transparent.

<Desolvation Step>

Into a vessel equipped with a stirrer and a thermometer, [Composite Particle Slurry 6] was charged, followed by desolvation at 30° C. for 8 hours while being stirred to thereby obtain [Dispersion Slurry 6]. A small amount of [Dispersion Slurry 6] was placed on a slide glass, covered with cover glasses, and then the appearance thereof was observed by an optical microscope (magnification: 200), and then colored particles uniform in size were observed. Further, 1 mL of [Dispersion Slurry 6] was sampled and diluted to 10 mL, followed by centrifugal separation. As a result, the supernatant fluid was white turbid and semi-transparent.

Thereafter, [Dispersion Slurry 6] was washed and dried in the same manner as in Example B3, and the resulting [Colored Resin Particle 6] was observed by a scanning electron microscope. As a result, vinyl resin particles were uniformly attached to surfaces of core particles.

Example B7

<Production of Oil Phase>

Pigment/Wax Dispersion Liquid produced in the same manner as in Example B1 (976 parts) and ethyl acetate (112 parts) were mixed at 5,000 rpm for 1 minute using a TK homomixer (manufactured by Tokushu Kikai Kogyo Co. Ltd.), and then [Isocyanate-Modified Polyester 1] (88 parts) was added thereto and mixed at 5,000 rpm for 1 minute by the TK homomixer (manufactured by Tokushu Kikai Kogyo Co. Ltd.) to obtain [Oil Phase 7]. The solid content of the resulting [Oil Phase 7] was measured and found to be 46.1% by mass, and the amount of ethyl acetate to the solid content was 117% by mass.

<Core Particle Production Step>

[Aqueous Phase 1] (1,200 parts) produced in the same manner as in Example B1 was added to the resulting [Oil Phase 7] and then mixed using a TK homomixer with the number of revolutions of the mixer being set to 7,500 rpm to 14,000 rpm for 2 minutes while controlling the liquid temperature to be within the range of 20° C. to 23° C. by cooling in a water bath for the purpose of suppressing a temperature increase due to shearing heat caused by the mixer and then stirred for 10 minutes while controlling the number of revolutions of a Three-One Motor equipped with an anchor blade from 130 rpm to 350 rpm to thereby obtain [Core Particle Slurry 7] in which liquid droplets of the oil phase were dispersed in the aqueous phase.

<Resin Fine Particle-Attaching Step>

A mixture ([Vinyl-Based Resin Fine Particle Dispersion Liquid 1] (106 parts) and ion exchanged water (71 parts) were mixed (solid content concentration: 15%)) was added dropwise into [Colored particle Slurry 7] over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 7]. Then, 1 mL of [Composite Particle Slurry 7] was sampled and diluted to 10 mL, followed by centrifugal separation. As a result, the supernatant fluid was transparent.

<Desolvation Step>

Into a vessel equipped with a stirrer and a thermometer, the thus obtained [Composite Particle Slurry 7] was charged, followed by desolvation at 30° C. for 8 hours while being stirred to thereby obtain [Dispersion Slurry 7]. A small amount of [Dispersion Slurry 7] was placed on a slide glass, covered with cover glasses, and then the appearance thereof was observed by an optical microscope (magnification: 200), and then colored particles uniform in size were observed. Further, 1 mL of [Dispersion Slurry 7] was sampled and diluted to 10 mL, followed by centrifugal separation. As a result, the supernatant fluid was transparent.

Thereafter, [Dispersion Slurry 7] was washed and dried in the same manner as in Example B1, and the resulting [Colored Resin Particle 7] was observed by a scanning electron microscope. As a result, vinyl resin particles were uniformly attached to surfaces of core particles.

Example B8

<Production of Oil Phase>

Pigment/Wax Dispersion Liquid produced in the same manner as in Example B1 (976 parts) and ethyl acetate (240 parts) were mixed at 5,000 rpm for 1 minute using a TK homomixer (manufactured by Tokushu Kikai Kogyo Co. Ltd.), and then [Isocyanate-Modified Polyester 1] (88 parts) was added thereto and mixed at 5,000 rpm for 1 minute by the TK homomixer (manufactured by Tokushu Kikai Kogyo Co. Ltd.) to obtain [Oil Phase 8]. The solid content of the resulting [Oil Phase 8] was measured and found to be 46.1% by mass, and the amount of ethyl acetate to the solid content was 117% by mass.

<Core Particle Production Step>

An aqueous phase produced in the same manner as in Example B1 (1,200 parts) was added to the resulting [Oil Phase 8] and then mixed using a TK homomixer with the number of revolutions of the mixer being set to 7,500 rpm to 14,000 rpm for 2 minutes while controlling the liquid temperature to be within the range of 20° C. to 23° C. by cooling in a water bath for the purpose of suppressing a temperature increase due to shearing heat caused by the mixer and then stirred for 10 minutes while controlling the number of revolutions of a Three-One Motor equipped with an anchor blade from 130 rpm to 350 rpm to thereby obtain [Core Particle Slurry 8] in which liquid droplets of the oil phase were dispersed in the aqueous phase.

<Resin Fine Particle-Attaching Step>

A mixture ([Vinyl-Based Resin Fine Particle Dispersion Liquid 1] (106 parts) and ion exchanged water (71 parts) were mixed (solid content concentration: 15%)) was added dropwise into [Colored particle Slurry 8] over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 8]. Then, 1 mL of [Composite Particle Slurry 8] was sampled and diluted to 10 mL, followed by centrifugal separation. As a result, the supernatant fluid was transparent.

<Desolvation Step>

Into a vessel equipped with a stirrer and a thermometer, the thus obtained [Composite Particle Slurry 8] was charged, followed by desolvation at 30° C. for 8 hours while being stirred to thereby obtain [Dispersion Slurry 8]. A small amount of [Dispersion Slurry 8] was placed on a slide glass, covered with cover glasses, and then the appearance thereof was observed by an optical microscope (magnification: 200), and then colored particles uniform in size were observed. Further, 1 mL of [Dispersion Slurry 8] was sampled and diluted to 10 mL, followed by centrifugal separation. As a result, the supernatant fluid was transparent.

Thereafter, [Dispersion Slurry 8] was washed and dried in the same manner as in Example B1 to obtain [Colored Resin Particle 8], and [Colored Resin Particle 8] was observed by a scanning electron microscope. As a result, vinyl resin particles were uniformly attached to surfaces of core particles.

Example B9

<Production of Oil Phase>

Pigment/Wax Dispersion Liquid produced in the same manner as in Example B1 (976 parts) and ethyl acetate (370 parts) were mixed at 5,000 rpm for 1 minute using a TK homomixer (manufactured by Tokushu Kikai Kogyo Co. Ltd.), and then [Isocyanate-Modified Polyester 1] (88 parts) was added thereto and mixed at 5,000 rpm for 1 minute by the TK homomixer (manufactured by Tokushu Kikai Kogyo Co. Ltd.) to obtain [Oil Phase 9]. The solid content of the resulting [Oil Phase 9] was measured and found to be 38.8% by mass, and the amount of ethyl acetate to the solid content was 158% by mass.

<Core Particle Production Step>

An aqueous phase produced in the same manner as in Example B1 (1,200 parts) was added to the resulting [Oil Phase 9] and then mixed using a TK homomixer with the number of revolutions of the mixer being set to 7,500 rpm to 14,000 rpm for 2 minutes while controlling the liquid temperature to be within the range of 20° C. to 23° C. by cooling in a water bath for the purpose of suppressing a temperature increase due to shearing heat caused by the mixer and then stirred for 10 minutes while controlling the number of revolutions of a Three-One Motor equipped with an anchor blade from 130 rpm to 350 rpm to thereby obtain [Core Particle Slurry 8] in which liquid droplets of the oil phase were dispersed in the aqueous phase.

<Resin Fine Particle-Attaching Step>

A mixture ([Vinyl-Based Resin Fine Particle Dispersion Liquid 1] (106 parts) and ion exchanged water (71 parts) were mixed (solid content concentration: 15%)) was added dropwise into [Colored particle Slurry 9] over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 9]. Then, 1 mL of [Composite Particle Slurry 9] was sampled and diluted to 10 mL, followed by centrifugal separation. As a result, the supernatant fluid was transparent.

<Desolvation Step>

Into a vessel equipped with a stirrer and a thermometer, the thus obtained [Composite Particle Slurry 9] was charged, followed by desolvation at 30° C. for 8 hours while being stirred to thereby obtain [Dispersion Slurry 9]. A small amount of [Dispersion Slurry 9] was placed on a slide glass, covered with cover glasses, and then the appearance thereof was observed by an optical microscope (magnification: 200), and then aggregated particles were observed, transparent particles were sparsely observed and a part of the transparent particles aggregated together with colored particles. Further, 1 mL of [Dispersion Slurry 9] was sampled and diluted to 10 mL, followed by centrifugal separation. As a result, the supernatant fluid was transparent.

Thereafter, [Dispersion Slurry 9] was washed and dried in the same manner as in Example B1 to obtain [Colored Resin Particle 9], and [Colored Resin Particle 9] was observed by a scanning electron microscope. As a result, vinyl resin particles were attached to surfaces of core particles, but some areas with sparse vinyl-based resin particles were found.

Example B10

<Production of Aqueous Phase>

Ion exchanged water (970 parts), a 25% by mass aqueous dispersion liquid of organic resin fine particles (sodium salt of sulfate of ethylene oxide adduct of a styrene-methacrylic acid-butyl acrylate-methacrylic acid copolymer) for dispersion stabilization (38 parts), a 48.5% by mass aqueous solution of sodium dodecyldiphenyl ether sulfonate (98 parts), and ethyl acetate (98 parts) were mixed and stirred to obtain a mixture having a pH of 6.2. Then, a 10% sodium hydroxide aqueous solution was added dropwise into the mixture so as to have a pH 9.5, thereby obtaining [Aqueous Phase 10].

<Production of Pigment/Wax Dispersion Liquid (Oil Phase)>

Into a vessel equipped with a stirrer and a thermometer, [Polyester 1] (545 parts), [paraffin wax (melting point: 74° C.)] (181 parts) and ethyl acetate (1,300 parts) were charged, the temperature thereof was increased to 80° C. while stirring and maintained at 80° C. for 5 hours, followed by cooling to 30° C. in 1 hour. Next, [Masterbatch 1] (500 parts) and ethyl acetate (100 parts) were charged into the vessel and mixed for 1 hour to obtain [Starting Material Solution 10].

[Starting Material Solution 10] (1,500 parts) was transferred to a vessel, and the pigment and wax were dispersed with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Subsequently, a 70% ethyl acetate solution of [Polyester 1] (655 parts) and ethyl acetate (31 parts) were added to [Starting Material Solution 10] and passed once through the bead mill under the conditions described above, thereby obtaining [Pigment/Wax Dispersion Liquid 10]. [Pigment/Wax Dispersion Liquid 10] (920 parts) was mixed at 5,000 rpm for 1 minute using a TK homomixer (manufactured by Tokushu Kikai Kogyo Co. Ltd.), and [Isocyanate-Modified Polyester 1] (88 parts) was added thereto and mixed at 5,000 rpm for 1 minute by the TK homomixer (manufactured by Tokushu Kikai Kogyo Co. Ltd.) to thereby obtain [Oil Phase 10]. The solid content of the resulting [Oil Phase 10] was measured and found to be 55.4% by mass, and the amount of ethyl acetate to the solid content was 81% by mass.

<Core Particle Production Step>

An aqueous phase produced in the same manner as in Example B1 (1,200 parts) was added to the resulting [Oil Phase 10] and then mixed using a TK homomixer with the number of revolutions of the mixer being set to 8,000 rpm to 15,000 rpm for 2 minutes while controlling the liquid temperature to be within the range of 20° C. to 23° C. by cooling in a water bath for the purpose of suppressing a temperature increase due to shearing heat caused by the mixer and then stirred for 10 minutes while controlling the number of revolutions of a Three-One Motor equipped with an anchor blade from 130 rpm to 350 rpm to thereby obtain [Core Particle Slurry 10] in which liquid droplets of the oil phase were dispersed in the aqueous phase.

<Resin Fine Particle-Attaching Step>

A mixture ([Vinyl-Based Resin Fine Particle Dispersion Liquid 1] (106 parts) and ion exchanged water (71 parts) were mixed (solid content concentration: 15%)) was added dropwise into [Colored particle Slurry 10] over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 10]. Then, 1 mL of [Composite Particle Slurry 10] was sampled and diluted to 10 mL, followed by centrifugal separation. As a result, the supernatant fluid was transparent.

<Desolvation Step>

Into a vessel equipped with a stirrer and a thermometer, the thus obtained [Composite Particle Slurry 10] was charged, followed by desolvation at 30° C. for 8 hours while being stirred to thereby obtain [Dispersion Slurry 10]. A small amount of [Dispersion Slurry 10] was placed on a slide glass, covered with cover glasses, and then the appearance thereof was observed by an optical microscope (magnification: 200), and then colored particles uniform in size were observed. Further, 1 mL of [Dispersion Slurry 10] was sampled and diluted to 10 mL, followed by centrifugal separation. As a result, the supernatant fluid was transparent.

Thereafter, [Dispersion Slurry 10] was washed and dried in the same manner as in Example B1 to obtain [Colored Resin Particle 10], and [Colored Resin Particle 10] was observed by a scanning electron microscope. As a result, vinyl resin particles were uniformly attached to surfaces of core particles.

Example B11

<Production of Aqueous Phase>

Ion exchanged water (970 parts), a 25% by mass aqueous dispersion liquid of organic resin fine particles (sodium salt of sulfate of ethylene oxide adduct of a styrene-methacrylic acid-butyl acrylate-methacrylic acid copolymer) for dispersion stabilization (38 parts), a 48.5% by mass aqueous solution of sodium dodecyldiphenyl ether sulfonate (98 parts), and ethyl acetate (98 parts) were mixed and stirred to obtain a mixture having a pH of 6.2. Then, a 10% sodium hydroxide aqueous solution was added dropwise into the mixture so as to have a pH 9.7, thereby obtaining [Aqueous Phase 11].

<Production of Pigment/Wax Dispersion Liquid (Oil Phase)>

Into a vessel equipped with a stirrer and a thermometer, [Polyester 1] (630 parts), [paraffin wax (melting point: 74° C.)] (172 parts) and ethyl acetate (1,050 parts) were charged, the temperature thereof was increased to 80° C. while stirring and maintained at 80° C. for 5 hours, followed by cooling to 30° C. in 1 hour. Next, [Masterbatch 1] (485 parts) and ethyl acetate (100 parts) were charged into the vessel and mixed for 1 hour to obtain [Starting Material Solution 11].

[Starting Material Solution 11] (1,500 parts) was transferred to a vessel, and the pigment and wax were dispersed with a bead mill (ULTRA VISCOMILL manufactured by Aimex Co., Ltd.) under the following conditions: liquid feed rate: 0.8 kg/hr, disc circumferential speed: 5 m/sec, 0.5 mm-zirconia bead filled at 80% by volume, and four passes. Subsequently, a 70% ethyl acetate solution of [Polyester 1] (580 parts) was added to [Starting Material Solution 11] and passed once through the bead mill under the conditions described above, thereby obtaining [Pigment/Wax Dispersion Liquid 11].

[Pigment/Wax Dispersion Liquid 11] (850 parts) was mixed at 5,000 rpm for 1 minute using a TK homomixer (manufactured by Tokushu Kikai Kogyo Co. Ltd.), and [Isocyanate-Modified Polyester 1] (88 parts) was added thereto and mixed at 5,000 rpm for 1 minute by the TK homomixer (manufactured by Tokushu Kikai Kogyo Co. Ltd.) to thereby obtain [Oil Phase 11]. The solid content of the resulting [Oil Phase 11] was measured and found to be 60.4% by mass, and the amount of ethyl acetate to the solid content was 66% by mass.

<Core Particle Production Step>

[Aqueous Phase 11] (1,200 parts) was added to the resulting [Oil Phase 11] and then mixed using a TK homomixer with the number of revolutions of the mixer being set to 8,000 rpm to 15,000 rpm for 3 minutes while controlling the liquid temperature to be within the range of 20° C. to 23° C. by cooling in a water bath for the purpose of suppressing a temperature increase due to shearing heat caused by the mixer and then stirred for 10 minutes while controlling the number of revolutions of a Three-One Motor equipped with an anchor blade from 130 rpm to 350 rpm to thereby obtain [Core Particle Slurry 11] in which liquid droplets of the oil phase were dispersed in the aqueous phase.

<Resin Fine Particle-Attaching Step>

A mixture ([Vinyl-Based Resin Fine Particle Dispersion Liquid 1] (106 parts) and ion exchanged water (71 parts) were mixed (solid content concentration: 15%)) was added dropwise into [Colored particle Slurry 11] over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 11]. Then, 1 mL of [Composite Particle Slurry 11] was sampled and diluted to 10 mL, followed by centrifugal separation. As a result, the supernatant fluid was white turbid and semi-transparent.

<Desolvation Step>

Into a vessel equipped with a stirrer and a thermometer, the thus obtained [Composite Particle Slurry 11] was charged, followed by desolvation at 30° C. for 8 hours while being stirred to thereby obtain [Dispersion Slurry 11]. A small amount of [Dispersion Slurry 11] was placed on a slide glass, covered with cover glasses, and then the appearance thereof was observed by an optical microscope (magnification: 200), and then colored particles uniform in size were observed. Further, 1 mL of [Dispersion Slurry 11] was sampled and diluted to 10 mL, followed by centrifugal separation. As a result, the supernatant fluid was white burbid and semi-transparent.

Thereafter, [Dispersion Slurry 11] was washed and dried in the same manner as in Example B1 to obtain [Colored Resin Particle 11], and [Colored Resin Particle 11] was observed by a scanning electron microscope. As a result, vinyl resin particles were attached to surfaces of core particles, but some areas with sparse vinyl-based resin particles were found.

Example B12

[Composite Particle Slurry 12] was obtained in the same manner as in Example B1, except that in <Resin Fine Particle-Attaching Step>, the dropping time of a mixture of ([Vinyl-Based Resin Fine Particle Dispersion Liquid 1] (106 parts) and ion exchanged water (71 parts) were mixed (solid content concentration: 15%) was changed from 3 minutes to 10 seconds. Then, 1 mL of the thus obtained [Composite Particle Slurry 12] was sampled and diluted to 10 mL, followed by centrifugal separation. As a result, the supernatant fluid was not white turbid and was transparent.

<Desolvation Step>

Into a vessel equipped with a stirrer and a thermometer, the thus obtained [Composite Particle Slurry 12] was charged, followed by desolvation at 30° C. for 8 hours while being stirred to thereby obtain [Dispersion Slurry 12]. A small amount of [Dispersion Slurry 12] was placed on a slide glass, covered with cover glasses, and then the appearance thereof was observed by an optical microscope (magnification: 200), and then transparent particles were sparsely observed and a part of the transparent particles aggregated together with colored particles. Further, 1 mL of [Dispersion Slurry 12] was sampled and diluted to 10 mL, followed by centrifugal separation. As a result, the supernatant fluid was not white burbid and was transparent.

Thereafter, [Dispersion Slurry 12] was washed and dried in the same manner as in Example B1 to obtain [Colored Resin Particle 12], and [Colored Resin Particle 12] was observed by a scanning electron microscope. As a result, vinyl resin particles were attached to surfaces of core particles, but some areas with sparse vinyl-based resin particles were found.

Example B13

<Resin Fine Particle-Attaching Step>

A mixture of ([Vinyl-Based Resin Fine Particle Dispersion Liquid 6] (106 parts) and ion exchanged water (71 parts) were mixed (solid content concentration: 15%)) was added dropwise into a core particle slurry (which was produced in the same manner as in Example B1) over 3 minutes while the core particle slurry being stirred using a Three-One Motor equipped with an anchor blade with the number of revolutions thereof being set from 130 rpm to 350 rpm and in a state where the liquid temperature was 22° C. After the dropping, the mixture was continuously stirred for 30 minutes while controlling the number of revolutions from 200 rpm to 450 rpm to thereby obtain [Composite Particle Slurry 13]. Then, 1 mL of [Composite Particle Slurry 13] was sampled and diluted to 10 mL, followed by centrifugal separation. As a result, the supernatant fluid was transparent.

<Desolvation Step>

Into a vessel equipped with a stirrer and a thermometer, the thus obtained [Composite Particle Slurry 13] was charged, followed by desolvation at 30° C. for 8 hours while being stirred to thereby obtain [Dispersion Slurry 13]. A small amount of [Dispersion Slurry 13] was placed on a slide glass, covered with cover glasses, and then the appearance thereof was observed by an optical microscope (magnification: 200), and then colored particles uniform in size were observed. Further, 1 mL of [Dispersion Slurry 13] was sampled and diluted to 10 mL, followed by centrifugal separation. As a result, the supernatant fluid was slightly white turbid but nearly transparent.

Thereafter, [Dispersion Slurry 13] was washed and dried in the same manner as in Example B1 to obtain [Colored Resin Particle 10], and [Colored Resin Particle 10] was observed by a scanning electron microscope. As a result, vinyl resin particles were uniformly attached to surfaces of core particles.

The evaluation results of adhesion properties of each toner obtained above are shown in Table 3.

TABLE 3

| | | Adhesion properties of fine particles | | | |
|---|---|---|---|---|---|
| | No. of dispersion | Transparency of supernatant fluid | | | |
| | liquid of vinyl- | After resin | After | Appearance of particles | |
| Example No. | based resin fine particle used | fine particle-attaching step | desolvation step | Observed by microscope | Observed by SEM |
| Ex. B1 | 1 | A | A | A | A |
| Ex. B2 | 2 | A | B | A | A |
| Ex. B3 | 3 | A | C | A | A |
| Ex. B4 | 1 | A | A | A | A |
| Ex. B5 | 2 | A | B | A | A |
| Ex. B6 | 3 | A | C | A | A |
| Ex. B7 | 1 | A | A | A | A |
| Ex. B8 | 1 | A | A | B | A |
| Ex. B9 | 1 | A | A | C | C |
| Ex. B10 | 1 | A | A | A | A |
| Ex. B11 | 1 | C | C | A | C |
| Ex. B12 | 1 | A | A | C | C |
| Ex. B13 | 6 | A | B | A | A |

<Degree Of Transparency of Supernatant Fluid>

The amount of resin fine particles remaining in the aqueous medium that was undergone a fine particle-attaching step was qualitatively determined from the degree of white turbidity of the supernatant fluid in a slurry. The following describes the criteria of the degree of transparency of the supernatant fluid:

A: No white turbidity was found and appeared to be transparent.

B: Slightly white turbid, but nearly transparent

C: White turbidity was found and appeared to be semi-transparent

D: The supernatant became white turbid and was apparently opaque.

<Observation of Cored Resin Particle through Optical Microscope>

The following describes the criteria of colored resin particles determined through an optical microscope:

A: No aggregated particles and transparent particles was found, and colored particles uniform in size were observed.

B: Some aggregated particles were observed in a part of colored particles uniform in size.

C: Some transparent particles as well as colored particles were observed, and a part of the transparent particles aggregated together with colored particles.

D: Transparent particles were present together with colored particles, and both of these particles aggregated.

<Observation of Cored Resin Particle through Scanning Electron Microscope (SEM)>

The following describes the criteria of colored resin particles determined through a scanning electron microscope:

A: Vinyl-based resin was uniformly attached to surfaces of core particles.

B: Vinyl-based resin was uniformly attached to surfaces of core particles, but sparsely attached portions were observed.

C: Almost no vinyl-based resin was present on surfaces of core particles.

The method for producing a colored resin particle of the present invention enables efficiently uniformly attaching resin fine particles onto core particles without undergoing a heating step and can produce the colored resin particle with less production environmental impact, and thus the method is suitable as a production of a latent electrostatic image-developing toner and of a colored resin particle for use in image formation on electronic paper.

What is claimed is:

1. A method for producing a colored resin particle, the method comprising:

preparing an oil phase in which at least a resin and a colorant are dissolved or dispersed in an organic solvent, preparing an aqueous phase containing at least a surfactant in an aqueous medium, dispersing the oil phase in the aqueous phase to prepare a colored particle dispersion liquid so as to form core particles, causing resin fine particles to adhere to surfaces of the core particles by adding at least the resin fine particles to the colored particle dispersion liquid, in which the core particles have been formed, wherein the resin fine particles are adhered to the surfaces of the core particles at a temperature of from 10° C. to 60° C., removing the solvent from the colored particle dispersion liquid to obtain colored resin particles, washing the colored resin particles, and drying the colored resin particles, wherein an inorganic base is dissolved in the colored particle dispersion liquid, wherein after adhering the resin fine particles to the surfaces of the core particles, the temperature is maintained no higher than the same range through the subsequent removing, washing and drying steps.

2. The method for producing a colored resin particle, according to claim 1, wherein the resin fine particles have a volume average particle diameter of 60 nm to 120 nm.

3. The method for producing a colored resin particle, according to claim 1, wherein the resin fine particles comprise a vinyl-based resin.

4. The method for producing a colored resin particle, according to claim 1, wherein in the causing the resin fine particles to adhere to the surfaces of the core particles, a vinyl-based resin fine particle dispersion liquid is introduced to the dispersion liquid to cause the resin fine particles to adhere to the surfaces of the core particles, and wherein the vinyl-based resin fine particle dispersion liquid contains vinyl-based resin fine particles dispersed in an aqueous medium, and wherein the vinyl-based resin fine particles are obtained by polymerization of a monomer mixture containing a compound having a vinyl polymerizable functional group and an acid group in an amount of 0% by mass to 7% by mass and an aromatic compound having at least a vinyl polymerizable functional group.

5. The method for producing a colored resin particle, according to claim 4, wherein the compound having a vinyl polymerizable functional group and an acid group is contained in an amount of 0% by mass in the monomer mixture.

6. The method for producing a colored resin particle, according to claim 4, wherein the aromatic compound having a vinyl polymerizable functional group is contained in an amount of 80% by mass or more in the monomer mixture.

7. The method for producing a colored resin particle, according to claim 4, wherein the aromatic compound having a vinyl polymerizable functional group is contained in an amount of 95% by mass or more in the monomer mixture.

8. The method for producing a colored resin particle, according to claim 4, wherein the aromatic compound having a vinyl polymerizable functional group is styrene.

9. The method for producing a colored resin particle, according to claim 3, wherein the vinyl-based resin contains a styrene-based monomer in an amount of 80% by mass or more.

10. The method for producing a colored resin particle, according to claim 1, wherein the inorganic base is added in the preparing the aqueous phase or the preparing the oil phase.

11. The method for producing a colored resin particle, according to claim 1, wherein the washing of the colored resin particle is a washing treatment with an acid.

12. The method for producing a colored resin particle, according to claim 1, wherein the resin has an acid value of from 2 mgKOH/g to 26 mgKOH/g.

13. The method for producing a colored resin particle, according to claim 1, wherein the resin is a polyester resin.

14. The method for producing a colored resin particle, according to claim 1, wherein a modified resin having an isocyanate group at a terminal thereof is dissolved in the oil phase.

15. The method for producing a colored resin particle, according to claim 14, wherein the modified resin has a polyester skeleton.

16. The method for producing a colored resin particle, according to claim 1, wherein the colored resin particle contains no amine compound having an active hydrogen-containing group.

17. The method for producing a colored resin particle according to claim 1, wherein the temperature at which the resin fine particles are adhered to the core particles is from 20° C. to 45° C.

* * * * *